US006969297B2

(12) United States Patent
Moore

(10) Patent No.: US 6,969,297 B2
(45) Date of Patent: Nov. 29, 2005

(54) APPARATUS AND METHOD FOR CONDITIONING AND MONITORING MEDIA USED FOR CHEMICAL-MECHANICAL PLANARIZATION

(75) Inventor: Scott E. Moore, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 77 days.

(21) Appl. No.: 09/782,892

(22) Filed: Feb. 13, 2001

(65) Prior Publication Data

US 2001/0006870 A1 Jul. 5, 2001

Related U.S. Application Data

(62) Division of application No. 09/387,063, filed on Aug. 31, 1999, now Pat. No. 6,306,008.

(51) Int. Cl.[7] ..... B24B 49/00; B24B 1/00

(52) U.S. Cl. ..... 451/5; 451/41; 451/287

(58) Field of Search ..... 451/5, 41, 56, 451/9, 10, 99, 285–290, 443, 444

(56) References Cited

U.S. PATENT DOCUMENTS

| | | | | |
|---|---|---|---|---|
| 3,031,195 | A | 4/1962 | Lunsford | 274/9 |
| 4,438,601 | A | 3/1984 | Olson | 451/444 |
| 4,462,188 | A | 7/1984 | Payne | 451/41 |
| 4,841,684 | A | 6/1989 | Hall, Jr. | 451/532 |
| 5,036,015 | A | 7/1991 | Sandhu et al. | 437/8 |
| 5,081,051 | A | 1/1992 | Mattingly et al. | 437/10 |
| 5,154,021 | A | 10/1992 | Bombardier et al. | 51/262 A |
| 5,216,843 | A | 6/1993 | Breivogel et al. | 51/131.1 |
| 5,245,796 | A | 9/1993 | Miller et al. | 451/444 |
| 5,384,986 | A | 1/1995 | Hirose et al. | 451/444 |
| 5,421,768 | A | 6/1995 | Fujiwara et al. | 451/288 |
| 5,456,627 | A | 10/1995 | Jackson et al. | 451/56 |

(Continued)

FOREIGN PATENT DOCUMENTS

| | | | |
|---|---|---|---|
| JP | 10315124 | 2/1998 | 37/4 |

*Primary Examiner*—M. Rachuba
(74) *Attorney, Agent, or Firm*—Dorsey & Whitney LLP

(57) ABSTRACT

A method and apparatus for conditioning and monitoring a planarizing medium used for planarizing a microelectronic substrate. In one embodiment, the apparatus can include a conditioning body having a conditioning surface that engages a planarizing surface of the planarizing medium and is movable relative to the planarizing medium. A force sensor is coupled to the conditioning body to detect a frictional force imparted to the conditioning body by the planarizing medium when the conditioning body and the planarizing medium are moved relative to each other. The apparatus can further include a feedback device that controls the motion, position, or force between the conditioning body and the planarizing medium to control the conditioning of the planarizing medium.

232 Claims, 7 Drawing Sheets

U.S. PATENT DOCUMENTS 5,522,965 A 6/1996 Chisholm et al. ..... 156/636.1
5,536,202 A 7/1996 Appel et al. ..... 451/285
5,578,529 A 11/1996 Mullins ..... 451/41
5,616,069 A 4/1997 Walker et al. ..... 451/56
5,618,447 A 4/1997 Sandhu ..... 438/14
5,624,303 A 4/1997 Robinson ..... 451/285
5,628,862 A 5/1997 Yu et al. ..... 156/345
5,645,682 A 7/1997 Skrovan ..... 156/636.1
5,658,190 A 8/1997 Wright et al. ..... 451/285
5,664,990 A 9/1997 Adams et al. ..... 451/60
5,692,947 A 12/1997 Talieh et al. ..... 451/41
5,738,574 A 4/1998 Tolles et al. ..... 451/288
5,743,784 A 4/1998 Birang et al. ..... 451/21
5,779,521 A 7/1998 Muroyama et al. ..... 451/56
5,827,112 A 10/1998 Ball ..... 451/56
5,833,519 A 11/1998 Moore ..... 451/56
5,868,605 A 2/1999 Cesna ..... 451/443
5,885,137 A 3/1999 Ploessl ..... 451/56
5,904,608 A 5/1999 Watanabe ..... 451/5
5,938,507 A 8/1999 Ko et al. ..... 451/443
5,961,373 A 10/1999 Lai et al. ..... 451/443
5,975,994 A 11/1999 Sandhu et al. ..... 451/444
5,997,385 A 12/1999 Nishio ..... 451/443
6,000,997 A 12/1999 Kao et al. ..... 451/7
6,042,457 A 3/2000 Wilson et al. ..... 451/443
6,093,080 A 7/2000 Inaba et al. ..... 451/443
6,095,908 A 8/2000 Torii ..... 451/443
6,135,859 A 10/2000 Tietz ..... 451/41
6,139,428 A 10/2000 Drill et al. ..... 451/56
6,149,512 A 11/2000 Wilson et al. ..... 451/443
6,213,846 B1 4/2001 Li et al. ..... 451/6
6,306,008 B1 * 10/2001 Moore ..... 451/5
6,645,046 B1 11/2003 Vogtmann et al. ..... 451/8

* cited by examiner

APPARATUS AND METHOD FOR CONDITIONING AND MONITORING MEDIA USED FOR CHEMICAL-MECHANICAL PLANARIZATION

CROSS-REFERENCE TO RELATED APPLICATION

This application is a divisional of U.S. patent application Ser. No. 09/387,063 filed Aug. 31, 1999 now U.S. Pat. No. 6,306,008.

TECHNICAL FIELD

The present invention relates to an apparatus and method for conditioning and monitoring media used for chemical-mechanical planarization of microelectronic substrates.

BACKGROUND OF THE INVENTION

Chemical-mechanical planarization ("CMP") processes remove material from the surface of a semiconductor wafer in the production of integrated circuits. FIG. 1 schematically illustrates a CMP machine 10 having a platen 20. The platen 20 supports a planarizing medium 21 that can include a polishing pad 27 having a planarizing surface 29 on which a planarizing liquid 28 is disposed. The polishing pad 27 may be a conventional polishing pad made from a continuous phase matrix material (e.g., polyurethane), or it may be a new generation fixed-abrasive polishing pad made from abrasive particles fixedly dispersed in a suspension medium. The planarizing liquid 28 may be a conventional CMP slurry with abrasive particles and chemicals that remove material from the wafer, or the planarizing liquid may be a planarizing solution without abrasive particles. In most CMP applications, conventional CMP slurries are used on conventional polishing pads, and planarizing solutions without abrasive particles are used on fixed abrasive polishing pads.

The CMP machine 10 also can include an underpad 25 attached to an upper surface 22 of the platen 20 and the lower surface of the polishing pad 27. A drive assembly 26 rotates the platen 20 (as indicated by arrow A), or it reciprocates the platen 20 back and forth (as indicated by arrow B). Because the polishing pad 27 is attached to the underpad 25, the polishing pad 27 moves with the platen 20.

A wafer carrier 30 positioned adjacent the polishing pad 27 has a lower surface 32 to which a wafer 12 may be attached. Alternatively, the wafer 12 may be attached to a resilient pad 34 positioned between the wafer 12 and the lower surface 32. The wafer carrier 30 may be a weighted, free-floating wafer carrier, or an actuator assembly 40 may be attached to the wafer carrier to impart axial and/or rotational motion (as indicated by arrows C and D, respectively).

To planarize the wafer 12 with the CMP machine 10, the wafer carrier 30 presses the wafer 12 face-downward against the polishing pad 27. While the face of the wafer 12 presses against the polishing pad 27, at least one of the platen 20 or the wafer carrier 30 moves relative to the other to move the wafer 12 across the planarizing surface 29. As the face of the wafer 12 moves across the planarizing surface 29, material is continuously removed from the face of the wafer 12.

One problem with CMP processing is that the throughput may drop, and the uniformity of the polished surface on the wafer may be inadequate, because waste particles from the wafer 12 accumulate on the planarizing surface 29 of the polishing pad 27. The problem is particularly acute when planarizing doped silicon oxide layers because doping softens silicon oxide and makes it slightly viscous as it is planarized. As a result, accumulations of doped silicon oxide glaze the planarizing surface 29 of the polishing pad 27 with a coating that can substantially reduce the polishing rate over the glazed regions.

To restore the planarizing characteristics of the polishing pads, the polishing pads are typically conditioned by removing the accumulations of waste matter with an abrasive conditioning disk 50. Conventional abrasive conditioning disks are generally embedded with diamond particles, and they are mounted to a separate actuator 55 on a CMP machine that can move the conditioning disk 50 rotationally, laterally, or axially, as indicated by arrows E, F, and G, respectively. Typical conditionally disks remove a thin layer of the pad material itself in addition to the waste matter to form a new, clean planarizing surface 29 on the polishing pad 27. Some conditioning processes also include disposing a liquid solution on the polishing pad 27 that dissolves some of the waste matter as the abrasive disks abrade the polishing surface.

One problem with conventional conditioning methods is that the conditioning disk 50 can lose effectiveness by wearing down or by having the interstices between abrasive particles plugged with particulate matter removed from the polishing pad 27. If the change in effectiveness is not detected, the polishing pad 27 may be insufficiently conditioned and subsequent planarizing operations may not remove a sufficient quantity of material from the wafer 12. Another problem is that the conditioning disk 50 may condition the polishing pad 27 in a nonuniform manner, for example, because the build-up of deposits on the polishing pad may be non-uniform or because the relative velocity between the polishing pad and the conditioning disk changes as the conditioning disk moves radially across the planarizing surface 29.

One approach to addressing the above problems is to measure a friction force at an interface with the polishing pad. U.S. Pat. No. 5,743,784 disclosed detecting the roughness of a polishing pad with a floating head apparatus positioned away from the conditioning disk. One drawback with this method is that the friction force detected by the floating head may not accurately represent the friction force between the conditioning disk and the polishing pad. Furthermore, the separate floating head adds to the overall complexity of the CMP apparatus.

Another approach is to measure a contact force between a conditioning end effector and the polishing pad, as disclosed in U.S. Pat. No. 5,456,627. As discussed above, a drawback with this approach is that the contact force may not adequately represent the friction force between the polishing pad and the conditioner.

U.S. Pat. No. 5,036,015 discloses sensing a change in friction between the wafer and the polishing pad by measuring changes in current supplied to motors that rotate the wafer and/or the polishing pad to detect the endpoint of planarization. However, this method does not address the problem of detecting the condition of the conditioning disk.

SUMMARY OF THE INVENTION

The present invention is directed toward methods and apparatuses for conditioning and monitoring a planarizing medium used for planarizing a microelectronic substrate. In one aspect of the invention, the apparatus can include a conditioning body having a conditioning surface configured to engage a planarizing surface of the planarizing medium.

In one embodiment (for example, when the planarizing medium includes a circular polishing pad, or an elongated polishing pad extending between a supply roller and a take-up roller) the conditioning body can have a circular planform shape. Alternatively, (for example, when the planarizing medium includes a high speed continuous loop polishing pad), the conditioning body can be elongated across a width of the polishing pad. At least one of the conditioning body and the planarizing medium is movable relative to the other to condition the planarizing surface.

The apparatus can further include a sensor coupled to the conditioning body to detect a frictional force imparted to the conditioning body by the planarizing medium when one of the conditioning body and the planarizing medium moves relative to the other. The sensor can be coupled to a support that supports the conditioning body relative to the planarizing medium. For example, the support can include two support members, one pivotable relative to the other, and the sensor can include a force sensor positioned between the two support members to detect a force applied by one support member to the other as the conditioning body engages the planarizing medium. Alternatively, the support can include a piston movably received in a cylinder and the sensor can include a pressure transducer within the cylinder or a pointer that detects motion of the piston relative to the cylinder.

In another aspect of the invention, the apparatus can include a feedback device that controls the relative velocity, position, or force between the conditioning body and the planarizing medium in response to a signal received form the sensor. In still another aspect of the invention, the conditioning body can be used to determine a characteristic of the planarizing medium, and can further be used to compare characteristics of one planarizing medium to characteristics of another.

DETAILED DESCRIPTION OF THE INVENTION

The present invention is directed toward methods and apparatuses for monitoring and conditioning planarizing media used for planarizing a microelectronic substrate. The apparatus can include a conditioning body having a sensor that detects friction between the conditioning body and the planarizing medium during conditioning. Many specific details of certain embodiments of the invention are set forth in the following description and in FIGS. 2–7 to provide a thorough understanding of such embodiments. One skilled in the art, however, will understand that the present invention may have additional embodiments and that they may be practiced without several of the details described in the following description.

Figure 1:
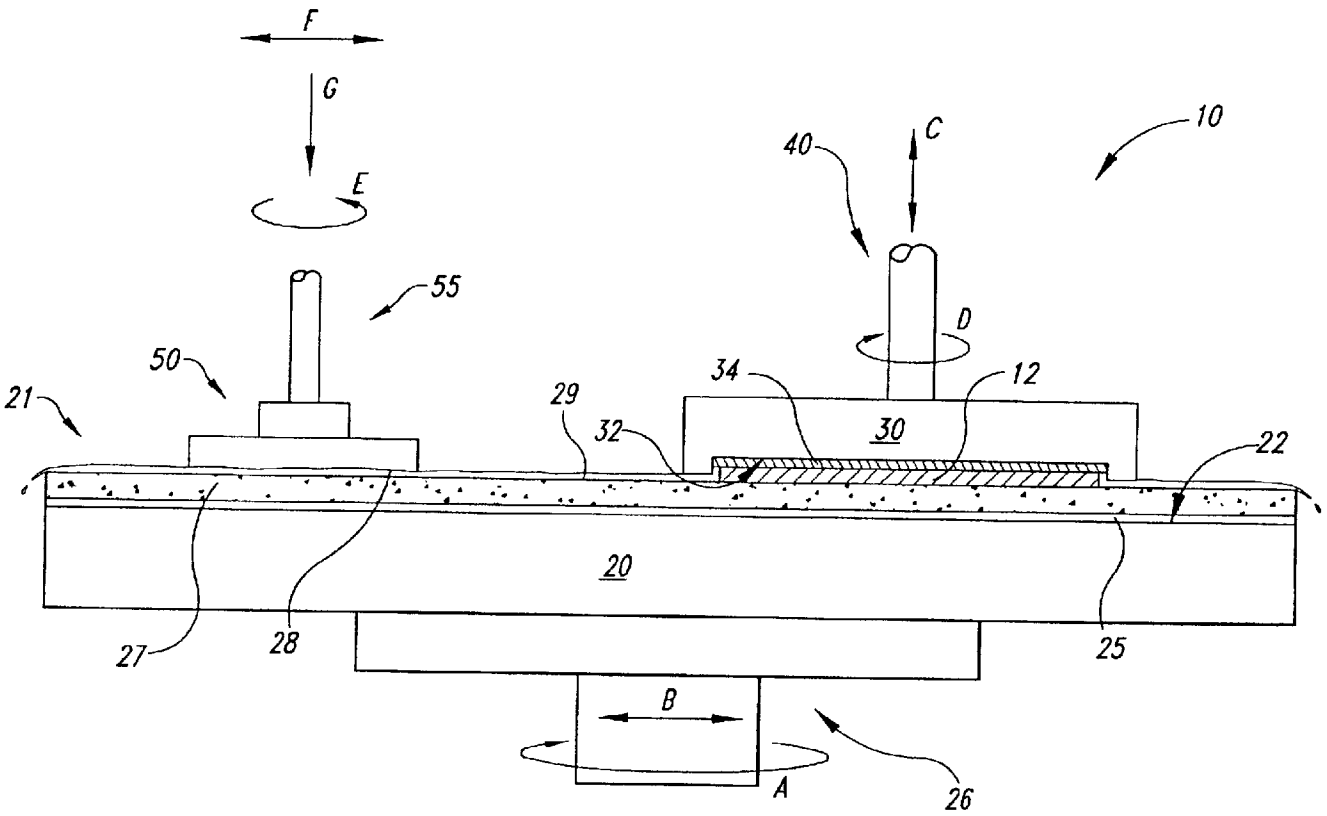
Fig. 1 (Prior Art)
FIG. 1 is a partially schematic, partial cross-sectional side elevation view of a chemical mechanical planarizing apparatus in accordance with the prior art.
Figure 2:
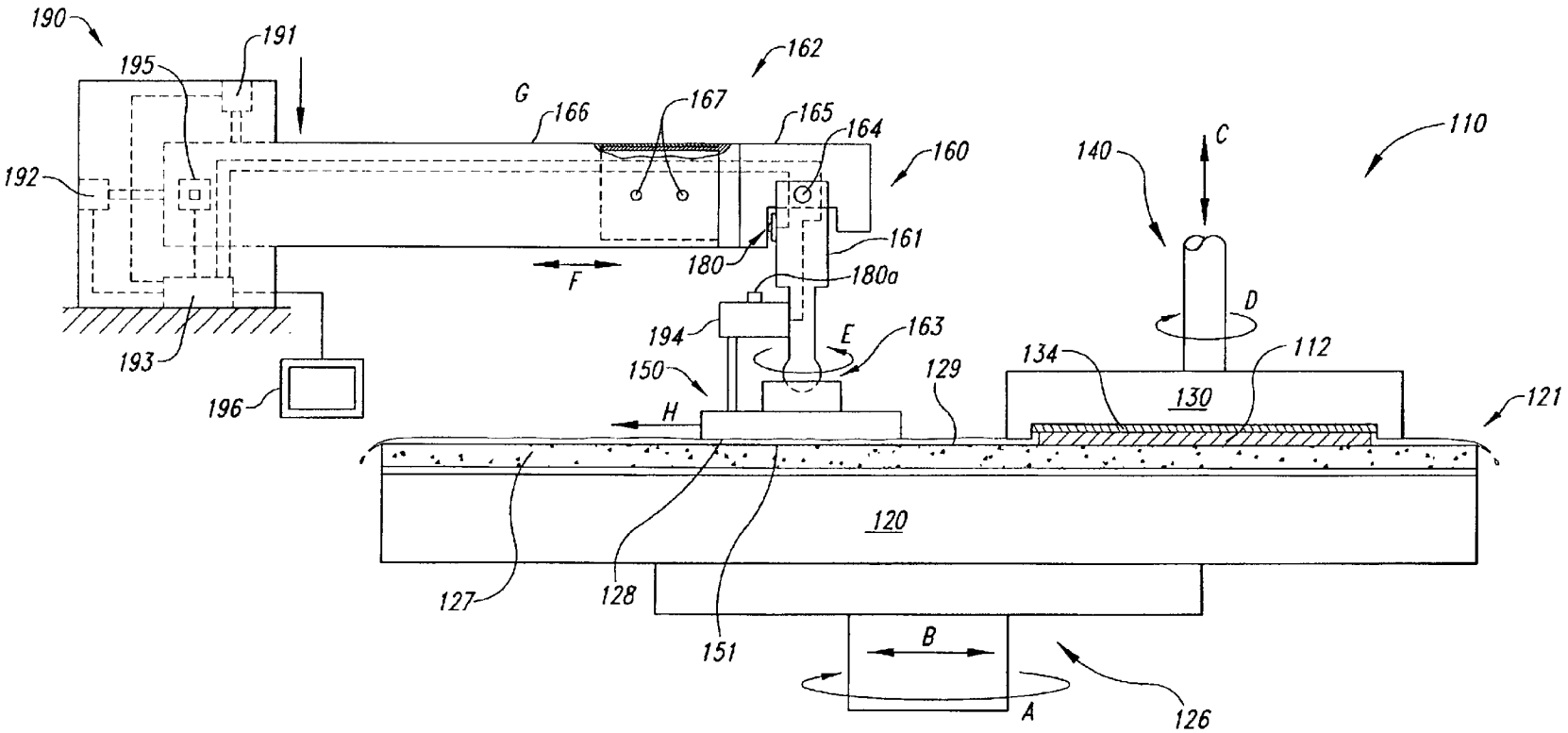
FIG. 2 is a partially schematic, partial cross-sectional side elevation view of an apparatus having a conditioning body and a pivoting support assembly in accordance with an embodiment of the invention.

FIG. 2 illustrates one embodiment of a CMP machine 110 in accordance with the invention having a platen 120 and a planarizing medium 121. In the embodiment shown in FIG. 2, the planarizing medium 121 includes a polishing pad 127 releasably attached to the platen 120 and a planarizing liquid 128 disposed on a planarizing surface 129 of the polishing pad 127. The platen 120 can be movable by means of a platen drive assembly 126 that can impart rotational motion (indicated by arrow A) and/or translational motion (indicated by arrow B) to the platen 120. As was discussed above, the CMP machine 110 can also include a carrier 130 and a resilient pad 134 that together press a microelectronic substrate 112 against the planarizing surface 129 of the polishing pad 127. A carrier drive assembly 140 can be coupled to the carrier 130 to move the carrier axially (indicated by arrow C) and/or rotationally (indicated by arrow D) relative to the platen 120.

The apparatus 110 can further include a conditioning body 150 supported relative to the planarizing medium 121 by a support assembly 160. The conditioning body 150 can have a generally circular planform shape and a conditioning surface 151 that can include abrasive particles such as diamonds or other relatively hard substances. In one embodiment, the conditioning body 150 can remain in a fixed position while the planarizing medium 121 rotates and/or translates beneath the conditioning surface 151. In another embodiment, an actuator unit 190 (shown schematically in FIG. 2) can move the conditioning body 150 relative to the planarizing medium 121, as will be discussed in greater detail below.

The support assembly 160 can include an upright support 161 coupled to the conditioning body 150 and a lateral support 162 coupled to the upright support 161. The upright support 161 can be coupled to the conditioning body 150 at a gimbal joint 163 to allow the conditioning body 150 to rotate and pivot relative to the upright support 161 during conditioning. The upright support 161 can be coupled to the lateral support 162 with a pivot pin 164 that allows the upright support 161 to pivot relative to the lateral support 162. The lateral support 162 can include a forward portion 165 removably coupled to a rear portion 166 with securing pins 167. Accordingly, the forward portion 165 can be used to retrofit an existing rear portion 166.

In one embodiment, a force sensor 180 is positioned between the upright support 161 and the lateral support 162 to detect a compressive force transmitted from the upright support 161 to the lateral support 162 when the conditioning body 150 and the planarizing medium 121 move relative to each other. In one aspect of this embodiment, the force sensor 180 can include an SLB series compression load cell available from Transducer Techniques of Temeculah, Calif.

In other embodiments, the force sensor 180 can include other devices, as will be discussed in greater detail below.

In operation, the conditioning body 150 is positioned on the platen 120, both to the left of center and forward of center as shown in FIG. 2. The platen 120 and the planarizing medium 121 rotate in the direction indicated by arrow A, such that the portion of the planarizing medium 121 in the foreground of FIG. 2 moves from right to left. Frictional forces between the planarizing medium 121 and the conditioning body 150 then impart a force on the conditioning body 150 in the direction indicated by arrow H. Under the influence of the force on the conditioning body 150, the upright support 161 tends to pivot in a clockwise direction about the pivot pin 164, compressing the force sensor 180 between the upright support 161 and the lateral support 162. The force sensor 180 can detect the compressive force and can also detect changes in the compressive force resulting from changes in the planarizing medium 121 and/or the conditioning body 150. For example, the frictional force between the planarizing medium 121 and the conditioning body 150 (and therefore the compressive force on the force sensor 180) may increase as the conditioning body 150 removes material from the planarizing surface 129 and roughens the planarizing surface. Conversely, the frictional force and the compressive force may decrease as the conditioning surface 151 of the conditioning body 150 becomes glazed with material removed form the polishing pad 127 and/or the conditioning body 150.

In an alternate embodiment, for example, where the conditioning body 150 contacts a portion of the planarizing medium 121 toward the rear of FIG. 2, the planarizing medium 121 can impart a frictional force on the conditioning body in a direction opposite that indicated by arrow H. Accordingly, the force sensor 180 can include a strain gauge or other device configured to detect tensile (as opposed to compressive) forces between the upright support 161 and the lateral support 162.

The actuator unit 190 can move the support assembly 160 and the conditioning body 150 relative to the planarizing medium 121, either in conjunction with or in lieu of moving the planarizing medium 121. In one embodiment, the actuator unit 190 can include a controller 193 coupled to one or more actuators (shown schematically in FIG. 2) for moving and/or biasing the conditioning body 150. For example, the controller 193 can be coupled to a lateral actuator 192 to move the support assembly 160 and the conditioning body 150 laterally as indicated by arrow F, and a sweep actuator 195 to sweep the support assembly 160 and the conditioning body 150 in a sweeping motion generally perpendicular to the plane of FIG. 2. The controller 193 can also be coupled to a downforce actuator 191 that can apply a downward force to the support assembly 160 in the direction indicated by arrow G to vary the force with which the conditioning body 150 contacts the planarizing medium 121.

Still further, the controller 193 can be coupled to a rotational actuator 194 for rotating the conditioning body 150 relative to the planarizing medium 121, as indicated by arrow E. In a further aspect of this embodiment, the force sensor 180 can be supplemented or replaced by an electrical current sensor 180*a* coupled to the rotational actuator 194. The current sensor 180*a* can detect changes in the current drawn by the rotational actuator 194 as the frictional forces between the conditioning body 150 and the planarizing medium 121 change. Alternatively, the current sensor 180*a* can be supplemented or replaced by another type of sensor, such as a torque sensor, deflection sensor or strain gauge, positioned in the drive train between the rotational actuator 194 and the conditioning body 150 to measure forces on the drive train caused by friction on the conditioning body 150.

In one embodiment, the force sensor 180 can be coupled to the controller 193 (as shown in dashed lines in FIG. 2) to provide a feedback loop for controlling the motion and/or downforce applied to the conditioning body 150 in response to changes detected by the force sensor 180. For example, the controller 193 can include a mechanical or microprocessor feedback unit that receives signals from the force sensor 180 and automatically controls the actuators, 191, 192, 194, and/or 195 to control the position of the conditioning body 150, the speed with which the conditioning body 150 moves relative to the planarizing medium 121, and/or the downforce between the conditioning body 150 and the polishing pad 127. In a further aspect of this embodiment, the controller 193 can signal the user if changing any of the above parameters does not result in the desired change in frictional force. Accordingly, the controller 193 can prevent the conditioning body 150 from applying an excessive force to the planarizing medium 121.

In an alternate embodiment, the force detected by the force sensor 180 can be displayed to the user via a conventional display device 196, such as a digital display, strip chart recorder, graphic display or other type of display device. As the force sensor 180 detects a change in the frictional force between the conditioning body 150 and the planarizing medium 121, the user can clean or otherwise refurbish the conditioning body 150 and/or manually increase the downforce on the conditioning body 150 to increase the rate with which the conditioning body 150 conditions the planarizing medium 121.

The apparatus 110 can be operated according to one or more of several methods. For example, the force sensor 180 can monitor the frictional force between the conditioning body 150 and the planarizing medium 121 during in situ conditioning (which is simultaneous with planarizing the wafer 112) or ex situ conditioning (which is conducted separately from planarization). The controller 193 can adjust the downforce on the conditioning body, in response to signals received from the force sensor 180, to keep the frictional force between the conditioning body 150 and the planarizing medium 121 approximately constant. For example, the frictional force can be a function of the surface characteristics of the planarizing surface 129 and/or the conditioning surface 151, the normal force between the two surfaces, and the relative velocity between the two surface. The relative velocity between the two surfaces can in turn be a function of the rotational and/or translational speed of the polishing pad 127, the position of the conditioning body 150 relative to the polishing pad 127. When the relative velocity is low, the frictional forces tend to be low. As the relative velocity increases, the frictional forces tend to increase until, at some point, the conditioning body 150 can "plane" on the planarizing liquid 128, which reduces the frictional force. Accordingly, one method of operation can include selecting a target frictional force and adjusting the rotation speed of the platen 120 to keep the actual frictional force approximately the same as the target frictional force. In other embodiments, other variables affecting the frictional force can be controlled, either manually or automatically via the controller 193, to keep the frictional force approximately constant.

In another method of operation, the force sensor 180 can be used to monitor the condition of the polishing pad 127. For example, a relatively light downforce can be applied to the conditioning body 150, generating a small frictional force between the conditioning body 150 and the polishing pad 127. The small frictional force can be either the weight of the conditioning body 150 or the weight combined with a downforce applied to the conditioning body 150 with the downforce actuator 191. During planarization, the frictional force can change (either upwardly or downwardly, depending on the characteristics of the polishing pad 127 and the type of material removed from the substrate 112), indicating a change in the effectiveness with which the polishing pad 127 planarizes the substrate 112. The force sensor 180 can detect this change and indicate to the user when the efficiency of the polishing pad 127 is less than optimal. In a further aspect of this embodiment, the controller 193 can increase the downforce on the conditioning body 150 upon detecting the change in characteristics of the polishing pad 127, and thereby condition the polishing pad 127 by removing material from the planarizing surface 129.

In still another method of operation, the rotational speed of the polishing pad 127 can be varied based on the position of the conditioning body 150 to maintain the relative linear velocity between the two approximately constant. For example, the rotational speed of the polishing pad 127 can decrease as the conditioning body 150 moves toward the periphery of the polishing pad 127 and can increase as the conditioning body 150 moves toward the center of the polishing pad 127. Accordingly, the downforce applied to the conditioning body 150 need not be adjusted as the conditioning body 150 moves relative to the polishing pad 127, except to account for changes in the surface conditions of the conditioning body 150 and the polishing pad 127.

In yet another method of operation, the apparatus 110 can be used to compare two or more polishing pads 127. For example, a selected downforce can be applied to the conditioning body 150 while the conditioning body engages a first polishing pad 127. The resulting frictional force, as measured by the force sensor 180 can be compared with the frictional force obtained when the conditioning body 150 engages a second polishing pad (not shown).

An advantage of the apparatus shown in FIG. 2 is that the force sensor 180 can detect changes in the performance of the conditioning body 150 as the conditioning body 150 conditions the polishing pad 127. The user can respond to the detected changes by adjusting the speed, position or surface characteristics of the conditioning body 150 to increase the operating efficiency of the conditioning body. A further advantage is that the force sensor 180 can be coupled to the controller 193 in a feedback loop to automatically adjust the performance of the conditioning body 150 by controlling the operation of one or more of the actuators 191, 192, 194, and 195. Accordingly, the speed, position and/or surface characteristics of the conditioning body 150 can be adjusted on a continuous or intermittent basis to uniformly condition the polishing pad 127.

Still a further advantage of the apparatus 110 is that the force sensor 180 can directly and therefore more accurately detect changes in the characteristics of the conditioning body 150. This arrangement is unlike some conventional arrangements in which a device separate from the conditioning body contacts the polishing pad 127 and detects a force which may or may not represent the forces on the conditioning body 150.

Yet another advantage is that the force sensor 180 can be used to detect changes in the roughness of the polishing pad 127. Accordingly, the apparatus 110 can be used to determine when the polishing pad 127 has been adequately conditioned, for example, when the frictional force between the polishing pad 127 and the conditioning body 150 exceeds a selected threshold value. Furthermore, the force sensor 180 can detect roughness variations across the planarizing surface 129 of the polishing pad 127 as the conditioning body is moved over the planarizing surface 129. For example, when the platen 20 rotates in the direction indicated by arrow A, the relative velocity between the conditioning body 150 and the polishing pad 127 will be higher toward the periphery of the polishing pad 127 then toward the center of the polishing pad, resulting in radial non-uniformities in the roughness of the planarizing surface 129. As discussed above, the actuators 191, 192, 194, and 195 can then be controlled by the controller 193 to reduce the roughness variations across the planarizing surface 129.

Figure 3:
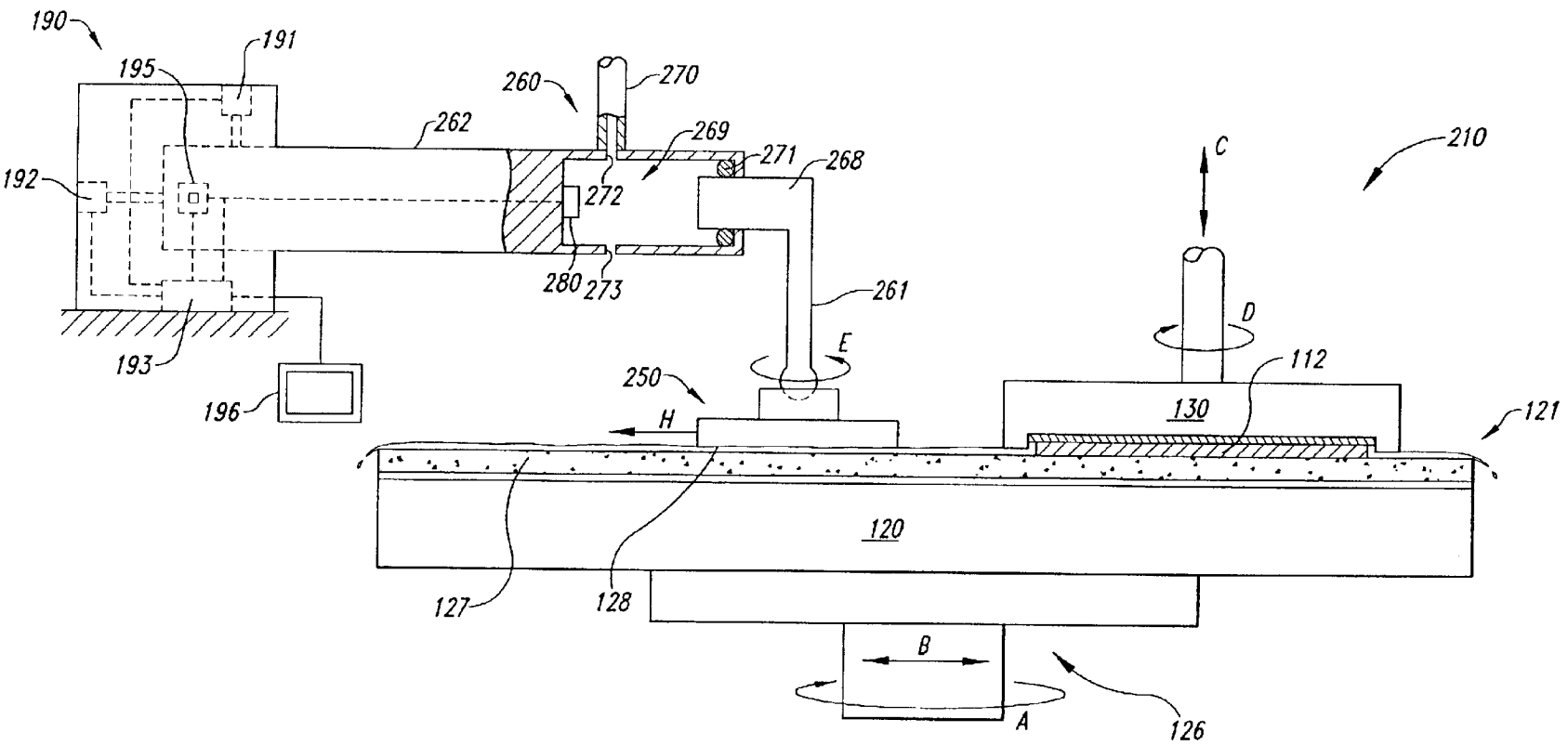
FIG. 3 is a partially schematic, partial cross-sectional side elevation view of an apparatus having a conditioning body supported by a support assembly that includes a piston movably received in a cylinder in accordance with another embodiment of the invention.

FIG. 3 is a partially schematic, partial cross-sectional side elevation view of an apparatus 210 in accordance with another embodiment of the invention. The apparatus includes a conditioning body 250 positioned adjacent the planarizing medium 121 in a manner generally similar to that discussed above with reference to FIG. 2. The conditioning body 250 is coupled to a support assembly 260 having an upright support 261 coupled at one end to the conditioning body 250 and coupled at the other end to a lateral support 262. As shown in FIG. 3, the lateral support 262 can include an open-ended cylinder portion 269 sized to slidably receive a corresponding piston portion 268 of the upright support 261.

In one embodiment, both the cylinder portion 269 and the piston portion 268 can have generally circular cross-sectional shapes and in other embodiments, both portions can have square or other cross-sectional shapes. In any case, a seal 271 can be positioned between the piston portion 268 and the walls of the cylinder portion 269 to slide relative to the cylinder portion 269. Accordingly, the piston portion 268 can slide slightly further into the cylinder portion 269 as the frictional force between the planarizing medium 121 and the conditioning body increases, and can slide slightly out of the cylinder portion 269 as the frictional force decreases.

A force sensor 280, such as a pressure transducer, can be positioned within the cylinder portion to detect changes in pressure within the cylinder portion 269 as the piston portion 268 moves relative to the cylinder portion under the force imparted to it by the conditioning body 250. In one aspect of this embodiment, the cylinder portion 269 can include an air supply conduit 270 that introduces a small amount of air through an inlet opening 272 in a wall of the cylinder portion 269. The air can entrain particulates within the cylinder portion 269 and purge them through an outlet opening 273. In a further aspect of this embodiment, the inlet opening 272 and the outlet opening 273 are sized such that the flow of air through the cylinder portion 269 does not adversely affect the measurements of the force sensor 280. Alternatively, the inlet opening 272, the outlet opening 273 and the conduit 270 can be eliminated.

An advantage of the apparatus 210 shown in FIG. 3 is that the force sensor 280 can detect changes in the frictional force between the conditioning body 250 and the planarizing medium 121 as the piston portion 268 moves both into and out of the cylinder portion 269. Accordingly, a single force sensor 280 can detect both increases and decreases in the frictional force between the conditioning body 250 and the planarizing medium 121. Alternatively, the single force sensor 280 can detect changes in the frictional force if the platen rotates either in the direction indicated by arrow A, or the opposite direction. Another advantage is that the environment within which the force sensor 280 operates can either be sealed or purged to reduce the likelihood for contamination of the force senor 280, improving the reliability of measurements made by the force sensor.

Figure 4:
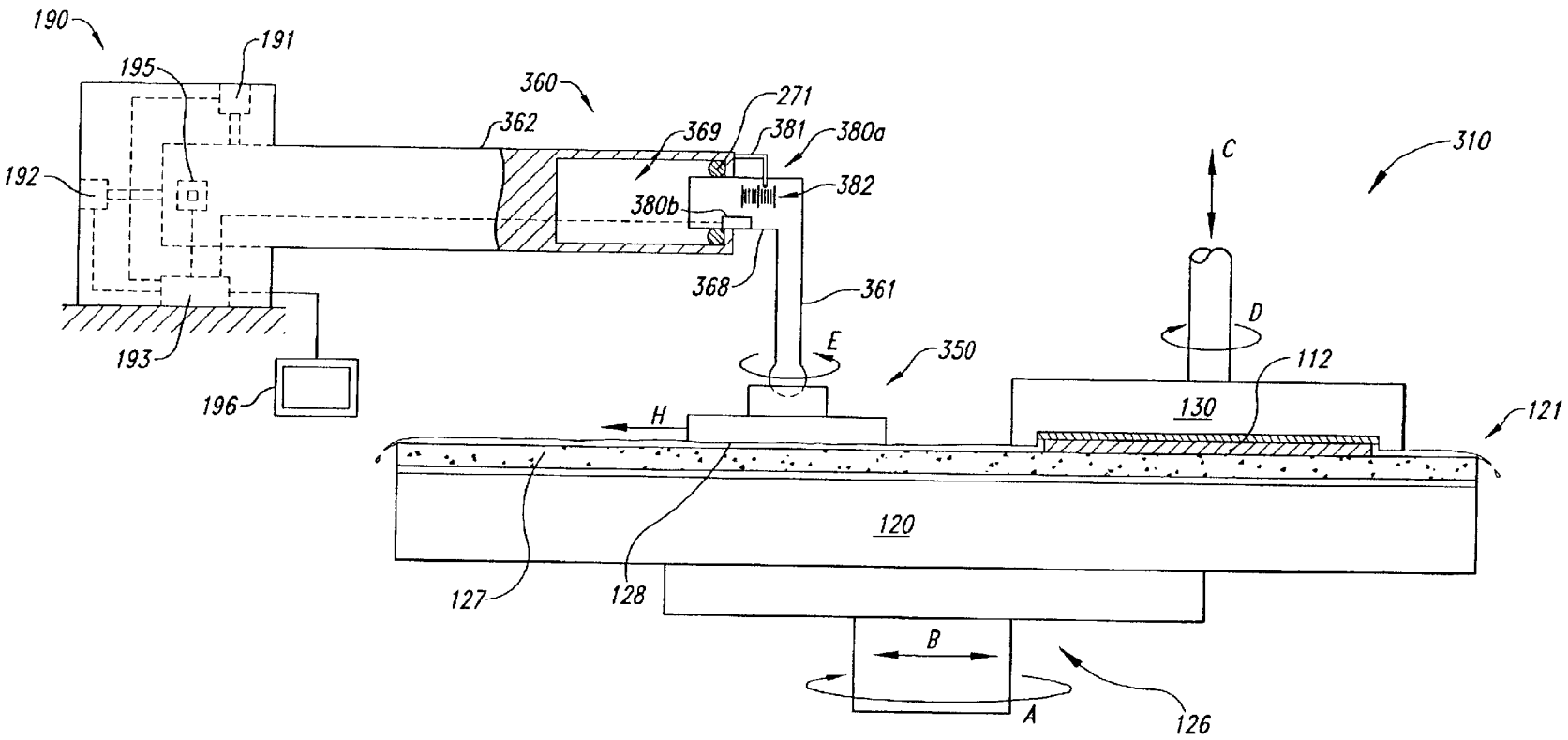
FIG. 4 a partially schematic, partial cross-sectional side elevation view of an apparatus having a conditioning body coupled to a support assembly that includes a sensor positioned to detect linear motion of the conditioning body in accordance with still another embodiment of the invention.
Figure 5:
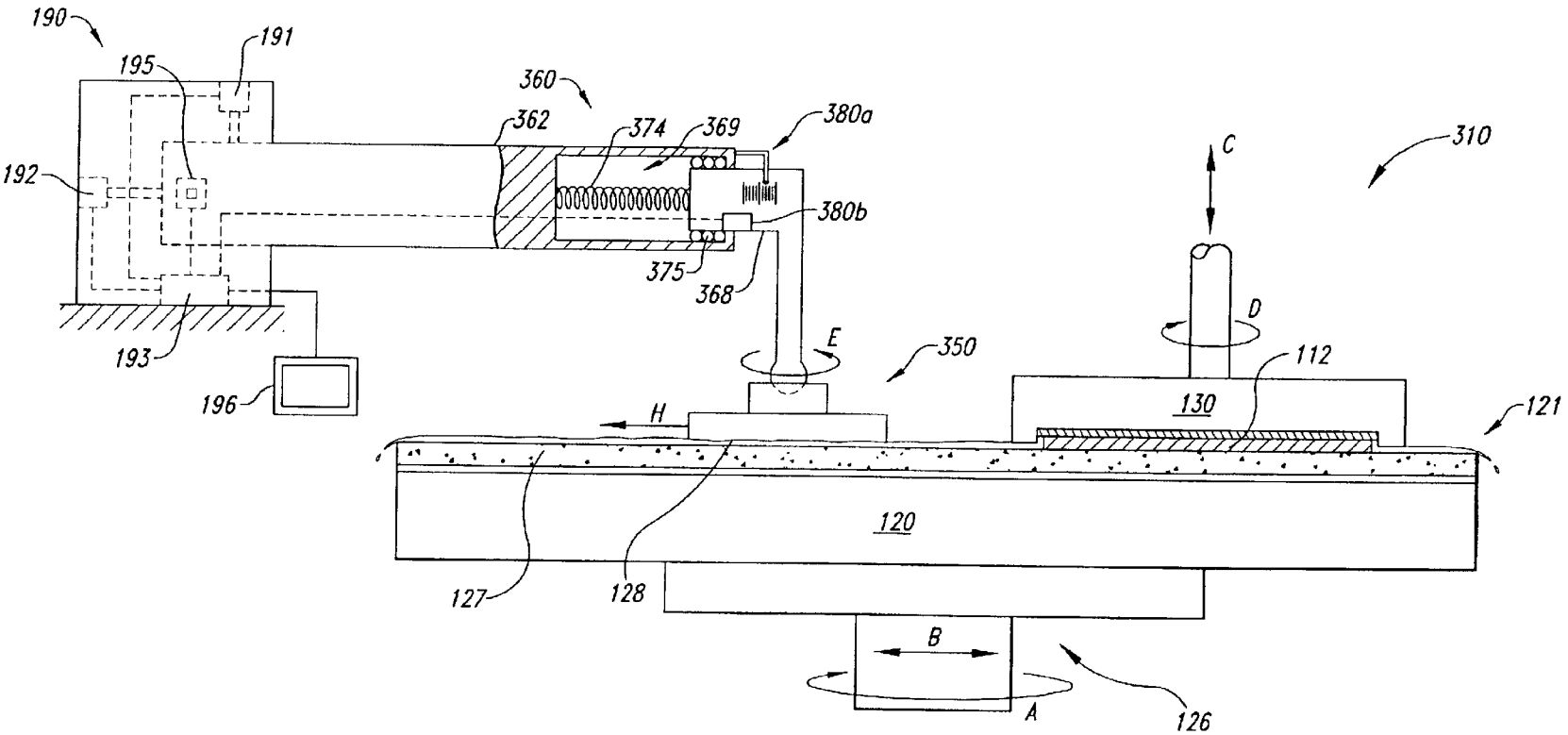
FIG. 5 is a partially schematic, partial cross-sectional side elevation view of an apparatus having a conditioning body coupled to a support assembly that includes a piston biased within a cylinder in accordance with yet another embodiment of the invention.

FIG. 4 is a partially schematic, partial cross-sectional side elevation view of an apparatus 310 in accordance with another embodiment of the invention. The apparatus 310 includes a conditioning body 350 coupled to a support assembly 360 in a manner generally similar to that discussed above with reference to FIG. 3. The support assembly 360 includes an upright support 361 having a piston portion 368 that is sealably and slidably received in a corresponding cylinder portion 369 of a lateral support 362. In one aspect of this embodiment, the apparatus 310 can have a sensor 380*a* that includes a pointer 381 coupled to the lateral support 362 and a scale 382 on the upright support 361. As the frictional forces between the conditioning body 350 and the planarizing medium 121 change, the upright support 361 tends to move relative to the lateral support 362. The relative motion between the upright support 361 and the lateral support 362 can be detected visually by observing the relative motion between the pointer 381 and the scale 382.

In another embodiment, the force sensor 380*a* can be supplemented by or replaced by a force sensor 380*b* that includes a linear displacement transducer. For example, in one aspect of this embodiment, the linear displacement transducer 380*b* can include a magnet in one or the other of the piston portion 368 and the cylinder portion 369 and a magnetic field detector in the other portion. In other embodiments, the linear displacement transducer 380*b* can include other devices. In any case, the linear displacement transducer 380*b* can generate an electrical signal that is transmitted to the controller 193 in a manner generally similar to that discussed above with reference to FIG. 2. The controller 193 can in turn transmit signals to the actuators 191, 192 and 195, also in a manner generally similar to that discussed above with reference to FIG. 2 (for purposes of illustration, the rotational actuator 194 shown in FIG. 2 is not shown in FIG. 4). An advantage of the apparatus 310 shown in FIG. 4 is that it can provide a mechanical visual indicator of the frictional force between the conditioning body 350 and the planarizing medium 121, in addition to or in lieu of a digital signal for controlling the motion of the conditioning body 350.

As shown in FIG. 4, the piston portion 368 is sealably engaged within the cylinder portion 369 so that a cushion of air within the cylinder portion 369 resists axial motion of the piston portion 368. In another embodiment, shown in partial cross-sectional elevation view in FIG. 5, the resistance can be provided by a spring 374 positioned between the piston portion 368 and an end wall of the cylinder portion 369. The spring 374 can resist motion of the piston portion 368 into and/or out of the cylinder portion 369. Accordingly, the piston portion 368 need not be sealably engaged with the cylinder portion 369. In one aspect of the embodiment, one or more bearings 375 can be positioned between the cylinder portion 369 and the piston portion 368 to ensure that the piston portion moves smoothly and axially relative to the cylinder portion 369.

Figure 6:
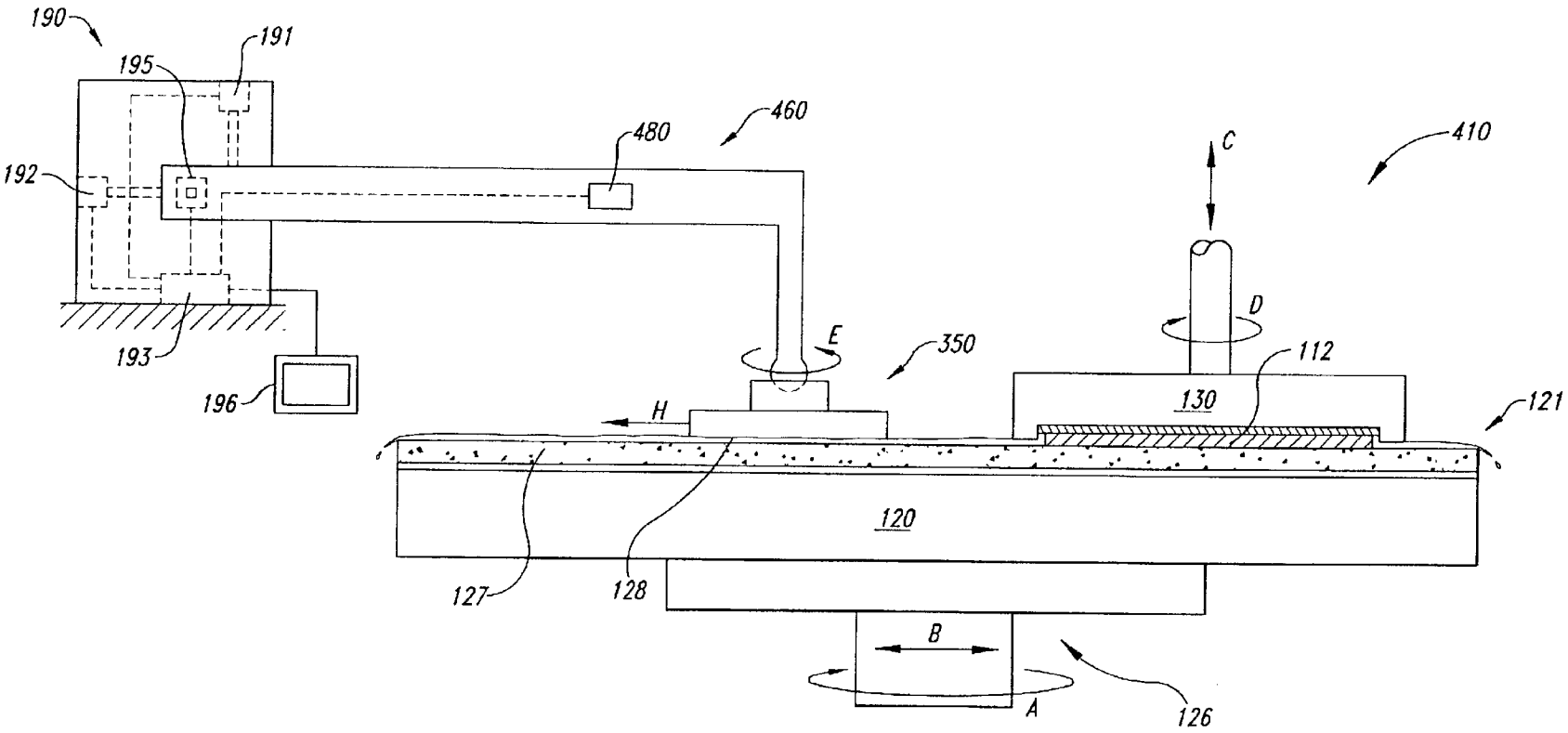
FIG. 6 is a partially schematic, partially schematic, partial cross-sectional side elevation view of an apparatus having a support assembly that includes a strain gauge in accordance with still another embodiment of the invention.

FIG. 6 is a partially schematic, partial cross-sectional side elevation view of an apparatus 410 having a support member 460 with a strain gauge 480 attached thereto in accordance with another embodiment of the invention. In one aspect of this embodiment, the support member 460 can include a single piece that extends from the actuator unit 190 to the conditioning body 350. The support member 460 can be generally rigid, but can also flex by a measurable amount as the frictional forces between the conditioning body 150 and the planarizing medium 121 change. The strain gauge 480 can be attached to the support member 460 at any suitable location where it can detect deflections of the support member.

In the embodiment shown in FIG. 6, the apparatus 410 includes a single strain gauge 480 and in other embodiments, the apparatus 410 can include a plurality of strain gauges to detect deflections of the support member 450 along one or more axes. In any case, the strain gauge(s) 480 can be coupled to the display device 196 to provide the user with a visual indication of the changes in frictional forces between the conditioning body 350 and the planarizing medium 121, and/or the strain gauge(s) 480 can be coupled to the controller 193 to automatically control the conditioning body 350 in response to the changes in frictional force. An advantage of the apparatus 410 shown in FIG. 6 is that it can include fewer moving parts than other apparatuses and may therefore be easier and less expensive to build and maintain.

Figure 7:
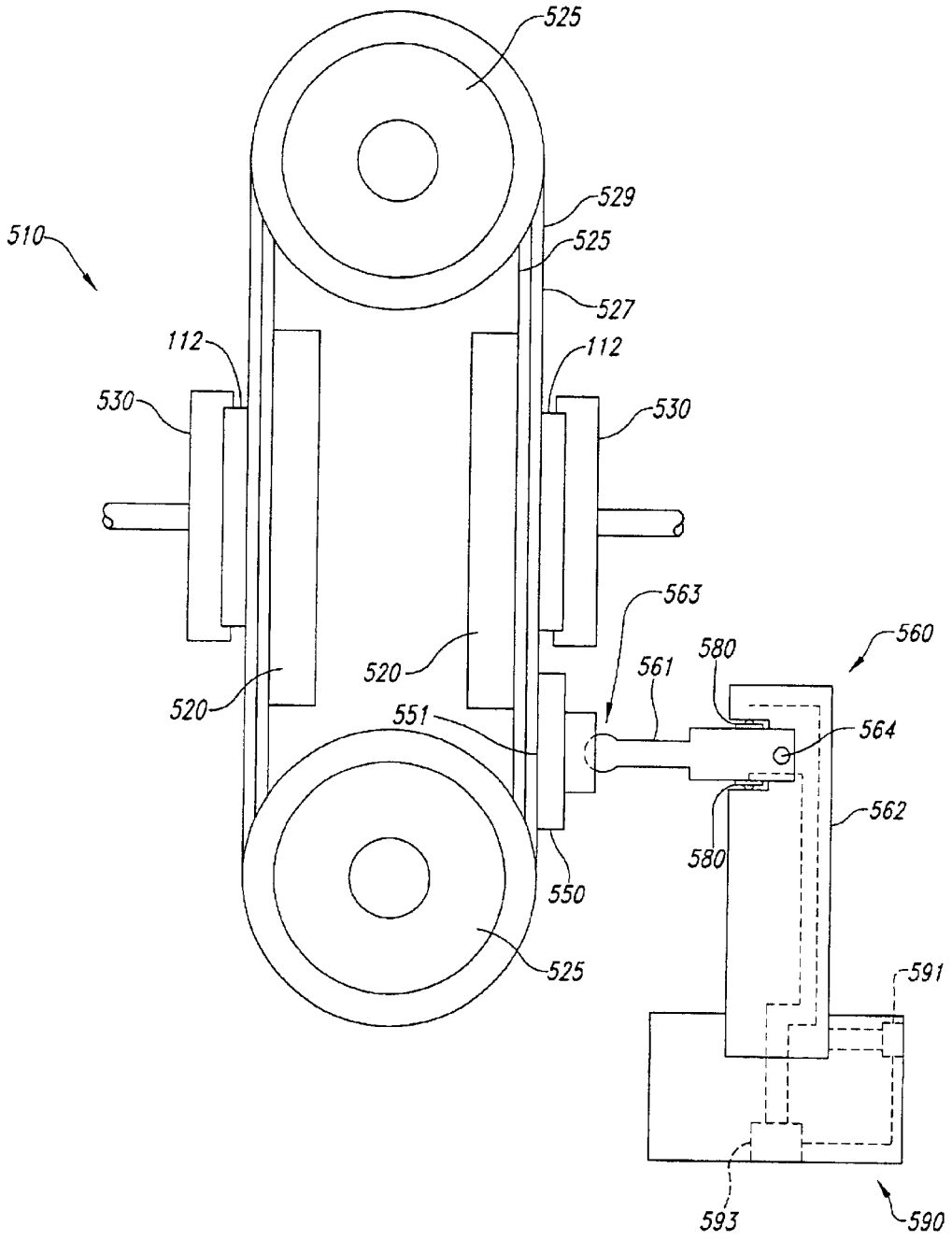
FIG. 7 is a partially schematic, side elevation view of an apparatus having a conditioning body and a continuous polishing pad in accordance with yet another embodiment of the invention.

FIG. 7 is a partially schematic, side elevation view of an apparatus 510 having two rollers 525 and a continuous polishing pad 527 extending around the two rollers 525. The polishing pad 527 has a planarizing surface 529 facing outwardly from the rollers 525 and can be supported by a continuous support band 525, formed from a flexible material, such as a thin sheet of stainless steel. A pair of platens 520 provide additional support for the polishing pad 527 at two opposing planarizing stations. Two carriers 530 aligned with the platens 520 at the planarizing stations can each bias a substrate 112 against opposing outwardly facing portions of the polishing pad 527. Devices having the features discussed above with reference to FIG. 7 are available from Aplex, Inc. of Sunnyvale, Calif. under the name AVERA™. Similar devices with a horizontally oriented polishing pad 527 and a single carrier 530 are available from Lam Research Corp. of Fremont, Calif.

The apparatus 510 can further include a conditioning body 550 supported relative to the polishing pad 527 by a support assembly 560. The conditioning body 550 can have an abrasive conditioning surface 551 pressed against the polishing pad 527 to condition the polishing pad 527. In one embodiment, the conditioning body 550 can be elongated in a plane transverse to the plane of FIG. 7 to span the entire width of the polishing pad 527. In one aspect of this embodiment, the conditioning body 550 can be generally rigid in a direction normal to the polishing pad 527 so that a normal force applied to one portion of the conditioning body 550 is distributed over the width of the conditioning body 550. Alternatively, the conditioning body 550 can be compliant in the normal direction to isolate the normal forces applied to different portions of the conditioning body 550, as will be discussed in greater detail below.

The support assembly 560 presses the conditioning body 550 against the polishing pad 527 and can include a first support member 561 coupled to the conditioning body 550 and a second support member 562 coupled to the first support member 561. The first support member 561 can be rigidly coupled to the conditioning body 550 or, alternatively, the first support member 561 can be coupled to the conditioning body 550 with a gimbal joint 563, as was discussed above with reference to FIG. 2. The first support member 561 can be coupled to the second support member 562 with a pivot pin 564 that allows the first support member 561 to pivot relative to the second support member 562 in a manner similar to that discussed above with reference to FIG. 2.

In one embodiment, a pair of force sensors 580 are positioned on opposite sides of the first support member 561 between the first support member 561 and the second support member 562 to detect forces transmitted from the first support member 561 to the second support member 562 when the polishing pad 527 moves relative to the conditioning body 550. Alternatively, the force sensors 580 can be positioned on other portions of the support assembly 560 or the conditioning body 550, so long as they are configured to detect the frictional forces between the conditioning body 550 and the polishing pad 527.

The apparatus 510 can also include an actuator unit 590 to apply forces to the conditioning body 550. For example, the actuator unit 590 can include a controller 593 coupled to a normal force actuator 591 to apply a force to the support assembly 560 that is normal to the polishing pad 527. Accordingly, the actuator unit 590 can vary the force with which the conditioning body 550 engages with the polishing pad 527. As was discussed above with reference to FIG. 2, the controller 593 can be coupled to the sensors 580 to change the normal force applied to the conditioning body 550 in response to signals received from the force sensors 580.

In one embodiment (for example, when the conditioning body 550 is generally rigid), the support assembly 560 can engage the conditioning body 550 midway across the span of the conditioning body 550 to apply an approximately uniform normal force across the width of the polishing pad 527. Alternatively, a plurality of support assemblies 560 can be coupled across the span of the conditioning body 550 to apply constant or variable forces to the conditioning body 550. For example, when the conditioning body 550 is compliant in the normal direction, each of the plurality of support assemblies 560 can independently control the normal force applied to a spanwise portion of the conditioning body 550. An advantage of this arrangement is that the normal force applied to the conditioning body 550 can be locally increased to account for local variations in the characteristics of the polishing pad 527 and/or the conditioning surface 551 of the conditioning body 550.

During operation, the continuous polishing pad 527 moves at a relatively high speed around the rollers 525 while the carriers 530 press the substrates 112 against the polishing pad 527. An abrasive slurry or other planarizing liquid having a suspension of abrasive particles is introduced to the surface of the polishing pad 527 which, in combination with the motion of the polishing pad 527 relative to the substrates 112, mechanically removes material from the substrates 112. The polishing pad 527 can be conditioned before, after, or during planarization with the conditioning body 550 by pressing the conditioning body against the polishing pad 527, in a manner generally similar to that discussed above with reference to FIGS. 2 and 7.

From the foregoing it will be appreciated that, although specific embodiments of the invention have been described herein for purposes of illustration, various modifications may be made without deviating from the spirit and scope of the invention. For example, the force sensor and conditioning bodies can be used in conjunction with rotary planarizing devices and continuous polishing pad devices, as shown in the figures, and can also be used with web-format planarizing devices in which the planarizing medium is scrolled across the platen from a supply roller to a take-up roller and the conditioner moves relative to the planarizing medium to condition the planarizing medium in a manner generally similar to that discussed above with reference to FIG. 2. Accordingly, the invention is not limited except as by the appended claims.

What is claimed is:

1. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarazing medium to condition the planarizing surface;

a first support member having first and second ends and being rotatably coupled toward the first end to the conditioning body, the second end of the first support member extending away from the conditioning body;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a second support member coupled at a pivotable coupling to the first support member toward the second end of the first support member, the sensor being positioned between the first and second support members, the first support member being pivotable relative to the second support member to transmit a force to the sensor corresponding to the frictional force;

a piston; and a cylinder having an open end and a closed end, the cylinder slidably receiving the piston, at least one of the piston and the cylinder being coupled to the conditioning body to slide relative to the other of the piston and the cylinder under the influence of the frictional force on the conditioning body, the piston and the cylinder defining a gap between an end of the piston and the closed end of the cylinder, the sensor including a gauge positioned to measure movement of the one of the piston and the cylinder relative to the other of the piston and the cylinder.

2. The apparatus of claim 1 wherein the planarizing medium includes a polishing pad.

3. The apparatus of claim 1 wherein the conditioning body has a conditioning surface generally parallel to the planarizing surface.

4. The apparatus of claim 1 wherein the conditioning body includes abrasive elements for abrading the planarizing surface of the planarizing medium.

5. The apparatus of claim 1 wherein the sensor includes a force sensor.

6. The apparatus of claim 1, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

7. The apparatus of claim 1 wherein the piston is sealably engaged with the cylinder.

8. The apparatus of claim 1, further comprising a biasing member coupled to the cylinder and the piston to bias the piston toward or away from the cylinder.

9. The apparatus of claim 1 wherein the gauge includes a pointer on one of the piston and the cylinder and a scale on the other of the piston and the cylinder, the pointer being aligned with the scale and movable relative to the scale to indicate relative movement between the piston and the cylinder.

10. An apparatus for measuring forces during conditioning of a chemical-mechanical planarizing surface, comprising:

a planarizing medium having a planarizing surface for removing material from a microelectronic substrate, the planarizing surface defining a planarizing surface plane;

a conditioning body adjacent to the planarizing medium, at least one of the conditioning body and the planarizing medium being movable relative to the other of the conditioning body and the planarizing medium for conditioning the planarizing surface, the conditioning body and the planarizing medium generating a force in the planarizing surface plane when the one of the conditioning body and the planarizing medium moves relative to the other of the conditioning body and the planarizing medium;

a first support member having first and second ends and being rotatably coupled toward the first end to the conditioning body, the second end of the first support member extending away from the conditioning body;

a second support member coupled at a pivotable coupling to the first support member toward the second end of the first support member, the sensor being positioned between the first and second support members, the first support member being pivotable relative to the second support member to transmit a force to the sensor corresponding to the drag force;

a sensor operatively coupled to the conditioning body to detect the force;

a piston; and a cylinder having an open end and a closed end, the cylinder slidably receiving the piston, at least one of the piston and the cylinder being coupled to the conditioning body to slide relative to the other of the piston and the cylinder under the influence of the force on the conditioning body, the piston and the cylinder defining a gap between an end of the piston and the closed end of the cylinder, the force sensor including a gauge positioned to measure movement of the piston relative to the cylinder.

11. The apparatus of claim 10 wherein the planarizing medium includes a polishing pad.

12. The apparatus of claim 10 wherein the conditioning body has a conditioning surface generally parallel to the planarizing surface.

13. The apparatus of claim 10 wherein the conditioning body is rotatable relative to the planarizing medium.

14. The apparatus of claim 10 wherein the conditioning body is translatable relative to the planarizing medium.

15. The apparatus of claim 10 wherein the planarizing medium is rotatable relative to the conditioning body.

16. The apparatus of claim 10 wherein the sensor includes a force sensor.

17. The apparatus of claim 10 wherein the piston is sealable engaged with the cylinder.

18. The apparatus of claim 10, further comprising a biasing member coupled to the cylinder and the piston to bias the piston toward or away from the cylinder.

19. The apparatus of claim 10, further comprising a feedback device coupled to the sensor and the conditioning body for changing at least one of the force between the conditioning body and the polishing pad and a position of the conditioning body relative to the polishing pad in response to a signal from the sensor.

20. An apparatus for monitoring conditioning of a planarizing medium used for chemical-mechanical planarization of a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface, the conditioning body generating a drag force generally parallel to the planarizing surface;

a piston;

a cylinder having an open end and a closed end, the cylinder slidably receiving the piston, at least one of the piston and the cylinder being coupled to the conditioning body to slide relative to the other of the piston and the cylinder under the influence of the force on the conditioning body, the piston and the cylinder defining a gap between an end of the piston and the closed end of the cylinder, the sensor being positioned to detect relative motion between the piston and the cylinder;

an actuator coupled to the conditioning body with a support assembly to control at least one of a generally normal force between the conditioning body and the planarizing medium and a position of the conditioning body relative to the planarizing medium;

a sensor coupled to the support assembly to detect the drag force; and a feedback device coupled to the actuator to control activation of the actuator in response to a signal received from the force sensor.

21. The apparatus of claim 20 wherein the feedback device includes a microprocessor.

22. The apparatus of claim 20 wherein the actuator is positioned to move the conditioning body laterally over the planarizing surface.

23. The apparatus of claim 20 wherein the actuator is positioned to rotate the conditioning body in a generally circular motion over the planarizing surface.

24. The apparatus of claim 20 wherein the planarizing medium includes a polishing pad.

25. The apparatus of claim 20, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the drag force.

26. The apparatus of claim 20 wherein the sensor includes a force sensor.

27. The apparatus of claim 20 wherein the piston is sealably engaged with the cylinder and the sensor includes a pressure gauge positioned within the gap to detect a change in pressure in the gap when one of the piston and the cylinder moves relative to the other.

28. The apparatus of claim 20, further comprising a biasing member coupled to the cylinder and the piston to bias the piston toward or away from the cylinder.

29. A method for monitoring conditioning of a planarizing medium used for planarizing a microelectronic substrate, comprising:

moving at least one of the planarizing medium and a conditioning body relative to the other of the planarizing medium and the conditioning body while the conditioning body is engaged with a planarizing surface of the planarizing medium, wherein the conditioning body is coupled to a support member for supporting the conditioning body relative to the planarizing medium, the support member including a generally upwardly extending portion coupled to the conditioning body and a generally laterally extending portion pivotably coupled to the upwardly extending portion, further wherein the support member includes a piston slidably received in a cylinder;

monitoring the conditioning body to detect a force of the planarizing medium on the conditioning body, wherein monitoring the conditioning body includes measuring a force transmitted to the support member by the conditioning body by detecting a movement of one of the piston and the cylinder relative to the other of the piston and the cylinder.

30. The method of claim 29 wherein monitoring the conditioning body includes detecting a frictional force on the conditioning body in a plane generally parallel to a plane of the planarizing surface.

31. The method of claim 29, further comprising biasing one of the piston and the cylinder toward or away from the other of the piston and the cylinder.

32. The method of claim 29 wherein the support member includes a piston slidably and sealably received in a cylinder to form a sealed space between an end of the cylinder and an end of the piston, further wherein monitoring the conditioning body includes detecting a pressure within the sealed space.

33. The method of claim 29, further comprising removing material from the planarizing medium while at least one of the conditioning body and the planarizing medium moves relative to the other of the conditioning body and the planarizing medium.

34. The method of claim 29, further comprising adjusting a force applied to the conditioning body approximately normal to the planarizing surface in response to detecting a force of the planarizing medium on the conditioning body.

35. The method of claim 29 wherein moving at least one of the planarizing medium and the conditioning body includes rotating the planarizing medium at a variable rate as the conditioning body moves across the planarizing medium to maintain a relative velocity between the planarizing medium and the conditioning body at an approximately constant value.

36. A method for monitoring conditioning of a planarizing medium used for planarizing a microelectronic substrate, the method comprising:

coupling a sensor to a conditioning body, wherein the conditioning body is coupled to a support member for supporting the conditioning body relative to the planarizing medium, and the support member includes a piston slidably received in a cylinder;

engaging the conditioning body with the planarizing medium and moving at least one of the conditioning body and the planarizing medium relative to the other of the conditioning body and the planarizing medium while the conditioning body engages the planarizing medium; and monitoring the conditioning body to detect a frictional force between the conditioning body and the planarizing medium, wherein monitoring the conditioning body includes measuring a force transmitted to the support member by the conditioning body by detecting a movement of one of the piston and the cylinder relative to the other of the piston and the cylinder.

37. The method of claim 36 wherein the support member includes a piston slidably and sealably received in a cylinder to form a sealed space between an end of the cylinder and an end of the piston, further wherein monitoring the conditioning body includes detecting a pressure within the sealed space.

38. A method for conditioning a planarizing medium used for planarizing a semiconductor substrate, the method comprising:

engaging a conditioning body with the planarizing medium, wherein the conditioning body is coupled to a support member for supporting the conditioning body relative to the planarizing medium, and further wherein the support member includes a generally upwardly extending portion coupled to the conditioning body and a generally laterally extending portion pivotably coupled to the upwardly extending portion;

moving at least one of the conditioning body and the planarizing medium relative to the other of the conditioning body and the planarizing medium to remove material from the planarizing medium; and maintaining an approximately constant frictional force between the conditioning body and the planarizing medium by adjusting a relative velocity between the conditioning body and the planarizing medium, wherein maintaining an approximately constant frictional force includes selecting a target frictional force, detecting a force between the upwardly extending portion and the laterally extending portion coupled to the conditioning body, and adjusting the relative velocity until the force is approximately equal to the target frictional force, and further wherein measuring a force transmitted to the support member includes detecting a force between the upwardly extending portion and the laterally extending portion with a force sensor.

39. The method of claim 38 wherein the support member includes a generally upwardly extending portion coupled to the conditioning body and a generally laterally extending portion pivotably coupled to the upwardly extending portion, further wherein detecting the force includes detecting a force between the upwardly extending portion and the laterally extending portion with a force sensor.

40. The method of claim 38 wherein the support member includes a piston slidably received in a cylinder and detecting the force includes detecting a movement of one of the piston and the cylinder relative to the other of the piston and the cylinder.

41. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a piston; and a cylinder having an open end and a closed end, the cylinder sealable and slidably receiving the piston, at least one of the piston and the cylinder being coupled to the conditioning body to slide relative to the other of the piston and the cylinder under the influence of the frictional force on the conditioning body, the piston and the cylinder defining a sealed gap between an end of the piston and the closed end of the cylinder, the sensor being positioned within the gap for measuring a change in pressure within the gap as the piston moves relative to the cylinder.

42. The apparatus of claim 41 wherein the planarizing medium includes a polishing pad.

43. The apparatus of claim 41 wherein the conditioning body has a conditioning surface generally parallel to the planarizing surface.

44. The apparatus of claim 41 wherein the conditioning body includes abrasive elements for abrading the planarizing surface of the planarizing medium.

45. The apparatus of claim 41, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the frictional force.

46. The apparatus of claim 41 wherein the sensor includes a force sensor.

47. The apparatus of claim 41, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

48. The apparatus of claim 41 wherein the piston has a generally circular cross-sectional shape and the cylinder has an aperture with a generally circular cross-sectional shape for receiving the piston.

49. The apparatus of claim 41 wherein the piston has a generally rectangular cross-sectional shape and the cylinder has an aperture with a generally rectangular cross-sectional shape for receiving the piston.

50. The apparatus of claim 41 wherein the piston is sealably engaged with the cylinder.

51. The apparatus of claim 41, further comprising a biasing member coupled to the cylinder and the piston to bias the piston toward or away from the cylinder.

52. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a piston; and a cylinder having an open end and a closed end, the cylinder sealably and slidably receiving the piston, at least one of the piston and the cylinder being coupled to the conditioning body to slide relative to the other of the piston and the cylinder under the influence of the frictional force on the conditioning body, wherein the piston has a generally circular cross-sectional shape and the cylinder has an aperture with a generally circular cross-sectional shape for receiving the piston, and further wherein the piston and the cylinder define a sealed gap between an end of the piston and the closed end of the cylinder, the sensor being positioned within the gap for measuring a change in pressure within the gap as the piston move relative to the cylinder.

53. The apparatus of claim 52 wherein the planarizing medium includes a polishing pad.

54. The apparatus of claim 52 wherein the conditioning body has a conditioning surface generally parallel to the planarizing surface.

55. The apparatus of claim 52 wherein the conditioning body includes abrasive elements for abrading the planarizing surface of the planarizing medium.

56. The apparatus of claim 52, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the frictional force.

57. The apparatus of claim 52 wherein the sensor includes a force sensor.

58. The apparatus of claim 52, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

59. The apparatus of claim 52 wherein the piston is sealably engaged with the cylinder.

60. The apparatus of claim 52, further comprising a biasing member coupled to the cylinder and the piston to bias the piston toward or away from the cylinder.

61. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a piston; and a cylinder having an open end and a closed end, the cylinder sealably and slidably receiving the piston, at least one of the piston and the cylinder being coupled to the conditioning body to slide relative to the other of the piston and the cylinder under the influence of the frictional force on the conditioning body, the piston and the cylinder defining a sealed gap between an end of the piston and the closed end of the cylinder, wherein the piston has a generally rectangular cross-sectional shape and the cylinder has an aperture with a generally rectangular cross-sectional shape for receiving the piston, and further wherein the sensor being positioned within the gap for measuring a change in pressure within the gap as the piston moves relative to the cylinder.

62. The apparatus of claim 61 wherein the planarizing medium includes a polishing pad.

63. The apparatus of claim 61 wherein the conditioning body has a conditioning surface generally parallel to the planarizing surface.

64. The apparatus of claim 61 wherein the conditioning body includes abrasive elements for abrading the planarizing surface of the planarizing medium.

65. The apparatus of claim 61, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the frictional force.

66. The apparatus of claim 61 wherein the sensor includes a force sensor.

67. The apparatus of claim 61, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

68. The apparatus of claim 61 wherein the piston is sealably engaged with the cylinder.

69. The apparatus of claim 61, further comprising a biasing member coupled to the cylinder and the piston to bias the piston toward or away from the cylinder.

70. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a piston; and a cylinder having an open end and a closed end, the cylinder slidably receiving the piston, at least one of the piston and the cylinder being coupled to the conditioning body to slide relative to the other of the piston and the cylinder under the influence of the frictional force on the conditioning body, the piston and the cylinder defining a gap between an end of the piston and the closed end of the cylinder, the sensor including a gauge positioned to measure movement of the one of the piston and the cylinder relative to the other of the piston and the cylinder.

71. The apparatus of claim 70 wherein the planarizing medium includes a polishing pad.

72. The apparatus of claim 70 wherein the conditioning body has a conditioning surface generally parallel to the planarizing surface.

73. The apparatus of claim 70 wherein the conditioning body includes abrasive elements for abrading the planarizing surface of the planarizing medium.

74. The apparatus of claim 70, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the frictional force.

75. The apparatus of claim 70 wherein the sensor includes a force sensor.

76. The apparatus of claim 70, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

77. The apparatus of claim 70 wherein the piston is sealably engaged with the cylinder.

78. The apparatus of claim 70, further comprising a biasing member coupled to the cylinder and the piston to bias the piston toward or away from the cylinder.

79. The apparatus of claim 70 wherein the gauge includes a pointer on one of the piston and the cylinder and a scale on the other of the piston and the cylinder, the pointer being aligned with the scale and movable relative to the scale to indicate relative movement between the piston and the cylinder.

80. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a piston; and a cylinder having an open end and a closed end, the cylinder slidably receiving the piston, at least one of the piston and the cylinder being coupled to the conditioning body to slide relative to the other of the piston and the cylinder under the influence of the frictional force on the conditioning body, the piston and the cylinder defining a gap between an end of the piston and the closed end of the cylinder, wherein the piston is sealably engaged with the cylinder and further wherein the sensor includes a gauge positioned to measure movement of the one of the piston and the cylinder relative to the other of the piston and the cylinder.

81. The apparatus of claim 80 wherein the planarizing medium includes a polishing pad.

82. The apparatus of claim 80 wherein the conditioning body has a conditioning surface generally parallel to the planarizing surface.

83. The apparatus of claim 80 wherein the conditioning body includes abrasive elements for abrading the planarizing surface of the planarizing medium.

84. The apparatus of claim 80, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the frictional force.

85. The apparatus of claim 80 wherein the sensor includes a force sensor.

86. The apparatus of claim 80, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

87. The apparatus of claim 80 wherein the piston has a generally circular cross-sectional shape and the cylinder has an aperture with a generally circular cross-sectional shape for receiving the piston.

88. The apparatus of claim 80 wherein the piston has a generally rectangular cross-sectional shape and the cylinder has an aperture with a generally rectangular cross-sectional shape for receiving the piston.

89. The apparatus of claim 80 wherein the piston is sealably engaged with the cylinder.

90. The apparatus of claim 80, further comprising a biasing member coupled to the cylinder and the piston to bias the piston toward or away from the cylinder.

91. The apparatus of claim 80 wherein the gauge includes a pointer on one of the piston and the cylinder and a scale on the other of the piston and the cylinder, the pointer being aligned with the scale and movable relative to the scale to indicate relative movement between the piston and the cylinder.

92. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a piston;

a cylinder having an open end and a closed end, the cylinder slidably receiving the piston, at least one of the piston and the cylinder being coupled to the conditioning body to slide relative to the other of the piston and the cylinder under the influence of the frictional force on the conditioning body, the piston and the cylinder defining a gap between an end of the piston and the closed end of the cylinder, the sensor including a gauge positioned to measure movement of the one of the piston and the cylinder relative to the other of the piston and the cylinder; and a biasing member coupled to the cylinder and the piston to bias the piston toward or away from the cylinder.

93. The apparatus of claim 92 wherein the planarizing medium includes a polishing pad.

94. The apparatus of claim 92 wherein the conditioning body has a conditioning surface generally parallel to the planarizing surface.

95. The apparatus of claim 92 wherein the conditioning body includes abrasive elements for abrading the planarizing surface of the planarizing medium.

96. The apparatus of claim 92, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the frictional force.

97. The apparatus of claim 92 wherein the sensor includes a force sensor.

98. The apparatus of claim 92, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

99. The apparatus of claim 92 wherein the piston has a generally circular cross-sectional shape and the cylinder has an aperture with a generally circular cross-sectional shape for receiving the piston.

100. The apparatus of claim 92 wherein the piston has a generally rectangular cross-sectional shape and the cylinder has an aperture with a generally rectangular cross-sectional shape for receiving the piston.

101. The apparatus of claim 92 wherein the piston is sealably engaged with the cylinder.

102. The apparatus of claim 92 wherein the gauge includes a pointer on one of the piston and the cylinder and a scale on the other of the piston and the cylinder, the pointer being aligned with the scale and movable relative to the scale to indicate relative movement between the piston and the cylinder.

103. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a piston; and a cylinder having an open end and a closed end, the cylinder slidably receiving the piston, at least one of the piston and the cylinder being coupled to the conditioning body to slide relative to the other of the piston and the cylinder under the influence of the frictional force on the conditioning body, the piston and the cylinder defining a gap between an end of the piston and the closed end of the cylinder, the sensor including a gauge positioned to measure movement of the one of the piston and the cylinder relative to the other of the piston and the cylinder, wherein the gauge includes a pointer on one of the piston and the cylinder and a scale on the other of the piston and the cylinder, the pointer being aligned with the scale and movable relative to the scale to indicate relative movement between the piston and the cylinder.

104. The apparatus of claim 103 wherein the planarizing medium includes a polishing pad.

105. The apparatus of claim 103 wherein the conditioning body has a conditioning surface generally parallel to the planarizing surface.

106. The apparatus of claim 103 wherein the conditioning body includes abrasive elements for abrading the planarizing surface of the planarizing medium.

107. The apparatus of claim 103, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the frictional force.

108. The apparatus of claim 103 wherein the sensor includes a force sensor.

109. The apparatus of claim 103, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

110. The apparatus of claim 103 wherein the piston has a generally circular cross-sectional shape and the cylinder has an aperture with a generally circular cross-sectional shape for receiving the piston.

111. The apparatus of claim 103 wherein the piston has a generally rectangular cross-sectional shape and the cylinder has an aperture with a generally rectangular cross-sectional shape for receiving the piston.

112. The apparatus of claim 103 wherein the piston is sealably engaged with the cylinder.

113. The apparatus of claim 103, further comprising a biasing member coupled to the cylinder and the piston to bias the piston toward or away from the cylinder.

114. An apparatus for measuring forces during conditioning of a chemical-mechanical planarizing surface, comprising:

a planarizing medium having a planarizing surface for removing material from a microelectronic substrate, the planarizing surface defining a planarizing surface plane;

a conditioning body adjacent to the planarizing medium, at least one of the conditioning body and the planarizing medium being movable relative to the other of the conditioning body and the planarizing medium for conditioning the planarizing surface, the conditioning body and the planarizing medium generating a force in the planarizing medium moves relative to the other of the conditioning body and the planarizing medium;

a piston;

a cylinder having an open end and a closed end, the cylinder slidably receiving the piston, at least one of the piston and the cylinder being coupled to the conditioning body to slide relative to the other of the piston and the cylinder under the influence of the force on the conditioning body, the piston and the cylinder defining a gap between an end of the piston and the closed end of the cylinder; and a sensor operatively coupled to the conditioning body to detect the force; the sensor including a gauge positioned to measure movement of the piston relative to the cylinder.

115. The apparatus of claim 114 wherein the planarizing medium includes a polishing pad.

116. The apparatus of claim 114 wherein the conditioning body has a conditioning surface generally parallel to the planarizing surface.

117. The apparatus of claim 114 wherein the conditioning body is rotatable relative to the planarizing medium.

118. The apparatus of claim 114 wherein the conditioning body is translatable relative to the planarizing medium.

119. The apparatus of claim 114 wherein the planarizing medium is rotatable relative to the conditioning body.

120. The apparatus of claim 114 wherein the force is a drag force, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the drag force.

121. The apparatus of claim 114 wherein the sensor includes a force sensor.

122. The apparatus of claim 114 wherein the piston is sealably engaged with the cylinder.

123. The apparatus of claim 114, further comprising a biasing member coupled to the cylinder and the piston to bias the piston toward or away from the cylinder.

124. The apparatus of claim 114, further comprising a feedback device coupled to the sensor and the conditioning body for changing at least one of the force between the conditioning body and the polishing pad and a position of the conditioning body relative to the polishing pad in response to a signal from the sensor.

125. An apparatus for measuring forces during conditioning of a chemical-mechanical planarizing surface, comprising:

a planarizing medium having a planarizing surface for removing material from a microelectronic substrate, the planarizing surface defining a planarizing surface plane;

a conditioning body adjacent to the planarizing medium, at least one of the conditioning body and the planarizing medium being movable relative to the other of the conditioning body and the planarizing medium for conditioning the planarizing surface, the conditioning body and the planarizing medium generating a force in the planarizing surface plane when the one of the conditioning body and the planarizing medium moves relative to the other of the conditioning body and the planarizing medium;

a piston;

a cylinder having an open end and a closed end, the cylinder slidably receiving the piston, at least one of the piston and the cylinder being coupled to the conditioning body to slide relative to the other of the piston and the cylinder under the influence of the force on the conditioning body, the piston and the cylinder defining a gap between an end of the piston and the closed end of the cylinder, wherein the piston is sealable engaged with the cylinder; and a sensor operatively coupled to the conditioning body to detect the force, the sensor including a gauge positioned to measure movement of the piston relative to the cylinder.

126. The apparatus of claim 125 wherein the planarizing medium includes a polishing pad.

127. The apparatus of claim 125 wherein the conditioning body has a conditioning surface generally parallel to the planarizing surface.

128. The apparatus of claim 125 wherein the conditioning body is rotatable relative to the planarizing medium.

129. The apparatus of claim 125 wherein the conditioning body is translatable relative to the planarizing medium.

130. The apparatus of claim 125 wherein the planarizing medium is rotatable relative to the conditioning body.

131. The apparatus of claim 125 wherein the force is a drag force, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the drag force.

132. The apparatus of claim 125 wherein the sensor includes a force sensor.

133. The apparatus of claim 125, further comprising a biasing member coupled to the cylinder and the piston to bias the piston toward or away from the cylinder.

134. The apparatus of claim 125, further comprising a feedback device coupled to the sensor and the conditioning body for changing at least one of the force between the conditioning body and the polishing pad and a position of the conditioning body relative to the polishing pad in response to a signal from the sensor.

135. An apparatus for measuring forces during conditioning of a chemical-mechanical planarizing surface, comprising:

a planarizing medium having a planarizing surface for removing material from a microelectronic substrate, the planarizing surface defining a planarizing surface plane;

a conditioning body adjacent to the planarizing medium, at least one of the conditioning body and the planarizing medium being movable relative to the other of the conditioning body and the planarizing medium for conditioning the planarizing surface, the conditioning body and the planarizing medium generating a force in the planarizing surface plane when the one of the conditioning body and the planarizing medium moves relative to the other of the conditioning body and the planarizing medium;

a piston;

a cylinder having an open end and a closed end, the cylinder slidably receiving the piston, at least one of the piston and the cylinder being coupled to the conditioning body to slide relative to the other of the piston and the cylinder under the influence of the force on the conditioning body, the piston and the cylinder defining a gap between an end of the piston and the closed end of the cylinder;

a biasing member coupled to the cylinder and the piston to bias the piston toward or away from the cylinder; and a sensor operatively coupled to the conditioning body to detect the force, the sensor including a gauge positioned to measure movement of the piston relative to the cylinder.

136. The apparatus of claim 135 wherein the planarizing medium includes a polishing pad.

137. The apparatus of claim 135 wherein the conditioning body has a conditioning surface generally parallel to the planarizing surface.

138. The apparatus of claim 135 wherein the conditioning body is rotatable relative to the planarizing medium.

139. The apparatus of claim 135 wherein the conditioning body is translatable relative to the planarizing medium.

140. The apparatus of claim 135 wherein the planarizing medium is rotatable relative to the conditioning body.

141. The apparatus of claim 135 wherein the force is a drag force, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the drag force.

142. The apparatus of claim 135 wherein the sensor includes a force sensor.

143. The apparatus of claim 135 wherein the piston is sealably engaged with the cylinder.

144. The apparatus of claim 135, further comprising a feedback device coupled to the sensor and the conditioning body for changing at least one of the force between the conditioning body and the polishing pad and a position of the conditioning body relative to the polishing pad in response to a signal from the sensor.

145. An apparatus for monitoring conditioning of a planarizing medium used for chemical-mechanical planarization of a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface, the conditioning body generating a drag force generally parallel to the planarizing surface;

a piston;

a cylinder having an open end and a closed end, the cylinder slidably receiving the piston, at least one of the piston and the cylinder being coupled to the conditioning body to slide relative to the other of the piston and the cylinder under the influence of the force on the conditioning body, the piston and the cylinder defining a gap between an end of the piston and the closed end of the cylinder, wherein the piston is sealably engaged with the cylinder;

an actuator coupled to the conditioning body with a support assembly to control at least one of a generally normal force between the conditioning body and the planarizing medium and a position of the conditioning body relative to the planarizing medium;

a sensor coupled to the support assembly to detect the drag force, the sensor including a pressure gauge positioned within the gap to detect a change in pressure in the gap when one of the piston and the cylinder moves relative to the other, the sensor is positioned to detect relative motion between the piston and the cylinder; and a feedback device coupled to the actuator to control activation of the actuator in response to a signal received from the force sensor.

146. The apparatus of claim 145 wherein the feedback device includes a microprocessor.

147. The apparatus of claim 145 wherein the actuator is positioned to move the conditioning body laterally over the planarizing surface.

148. The apparatus of claim 145 wherein the actuator is positioned to rotate the conditioning body in a generally circular motion over the planarizing surface.

149. The apparatus of claim 145 wherein the planarizing medium includes a polishing pad.

150. The apparatus of claim 145, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the drag force.

151. The apparatus of claim 145 wherein the sensor includes a force sensor.

152. The apparatus of claim 145, further comprising a biasing member coupled to the cylinder and the piston to bias the piston toward or away from the cylinder.

153. An apparatus for monitoring conditioning of a planarizing medium used for chemical-mechanical planarization of a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface, the conditioning body generating a drag force generally parallel to the planarizing surface;

a piston;

a cylinder having an open end and a closed end, the cylinder slidably receiving the piston, at least one of the piston and the cylinder being coupled to the conditioning body to slide relative to the other of the piston and the cylinder under the influence of the force on the conditioning body, the piston and the cylinder defining a gap between an end of the piston and the closed end of the cylinder defining a gap between an end of the piston and the closed end of the cylinder, an actuator coupled to the conditioning body with a support assembly to control at least one of a generally normal force between the conditioning body and the planarizing medium and a position of the conditioning body relative to the planarizing medium;

a sensor coupled to the support assembly to detect the drag force, the sensor being positioned to detect relative motion between the piston and the cylinder;

a feedback device coupled to the actuator to control activation of the actuator in response to a signal received from the force sensor; and a biasing member coupled to the cylinder and the piston to bias the piston toward or away from the cylinder.

154. The apparatus of claim 153 wherein the feedback device includes a microprocessor.

155. The apparatus of claim 153 wherein the actuator is positioned to move the conditioning body laterally over the planarizing surface.

156. The apparatus of claim 153 wherein the actuator is positioned to rotate the conditioning body in a generally circular motion over the planarizing surface.

157. The apparatus of claim 153 wherein the planarizing medium includes a polishing pad.

158. The apparatus of claim 153, further comprising:

a first support member having first and second ends and being rotatably coupled toward the first end to the conditioning body, the second end of the first support member extending away from the conditioning body; and a second support member coupled at a pivotable coupling to the first support member toward the second end of the first support member, the sensor being positioned between the first and second support members, the first support member being pivotable relative to the second support member to transmit a force to the sensor corresponding to the drag force.

159. The apparatus of claim 153 wherein the sensor includes a force sensor.

160. The apparatus of claim 153 wherein the piston is sealably engaged with the cylinder and the sensor includes a pressure gauge positioned within the gap to detect a change in pressure in the gap when one of the piston and the cylinder moves relative to the other.

161. A method for monitoring conditioning of a planarizing medium used for planarizing a microelectronic substrate, comprising:

moving at least one of the planarizing medium and a conditioning body relative to the other of the planarizing medium and the conditioning body while the conditioning body is engaged with a planarizing surface of the planarizing medium, wherein the conditioning body is coupled to a support member for supporting the conditioning body relative to the planarizing medium, the support member including a piston slidably received in a cylinder; and monitoring the conditioning body to detect a force of the planarizing medium on the conditioning body, wherein monitoring the conditioning body includes measuring a force transmitted to the support member by the conditioning body by detecting a movement of one of the piston and the cylinder relative to the other of the piston and the cylinder.

162. The method of claim 161 wherein monitoring the conditioning body includes detecting a frictional force on the conditioning body in a plane generally parallel to a plane of the planarizing surface.

163. The method of claim 161 wherein the support member includes a generally upwardly extending portion coupled to the conditioning body and a generally laterally extending portion pivotably coupled to the upwardly extending portion, further wherein monitoring the conditioning body includes detecting a force between the upwardly extending portion and the laterally extending portion with a force sensor.

164. The method of claim 161, further comprising biasing one of the piston and the cylinder toward or away from the other of the piston and the cylinder.

165. The method of claim 161 wherein the support member includes a piston slidably and sealably received in a cylinder to form a sealed space between an end of the cylinder and an end of the piston, further wherein monitoring the conditioning body includes detecting a pressure within the sealed space.

166. A method for monitoring conditioning of a planarizing medium used for planarizing a microelectronic substrate, comprising:

moving at least one of the planarizing medium and a conditioning body relative to the other of the planarizing medium and the conditioning body while the conditioning body is engaged with a planarizing surface of the planarizing medium, wherein the conditioning body is coupled to a support member for supporting the conditioning body relative to the planarizing medium, the support member including a piston slidably received in a cylinder;

biasing one of the piston and the cylinder toward or away from the other of the piston and the cylinder; and monitoring the conditioning body to detect a force of the planarizing medium on the conditioning body, wherein monitoring the conditioning body includes measuring a force transmitted to the support member by the conditioning body by detecting a movement of one of the piston and the cylinder relative to the other of the piston and the cylinder.

167. The method of claim 166 wherein monitoring the conditioning body includes detecting a frictional force on the conditioning body in a plane generally parallel to a plane of the planarizing surface.

168. The method of claim 166 wherein the support member includes a generally upwardly extending portion coupled to the conditioning body and a generally laterally extending portion pivotably coupled to the upwardly extending portion, further wherein monitoring the conditioning body includes detecting a force between the upwardly extending portion and the laterally extending portion with a force sensor.

169. The method of claim 166 wherein the support member includes a piston slidably and sealably received in a cylinder to form a sealed space between an end of the cylinder and an end of the piston, further wherein monitoring the conditioning body includes detecting a pressure within the sealed space.

170. A method for monitoring conditioning of a planarizing medium used for planarizing a microelectronic substrate, comprising:

moving at least one of the planarizing medium and a conditioning body relative to the other of the planarizing medium and the conditioning body while the conditioning body is engaged with a planarizing surface of the planarizing medium, wherein the conditioning body is coupled to a support member for supporting the conditioning body relative to the planarizing medium, the support member including a piston slidably and sealably received in a cylinder to form a sealed space between an end of the cylinder and an end of the piston; and monitoring the conditioning body to detect a force of the planarizing medium on the conditioning body, wherein monitoring the conditioning body includes measuring a force transmitted to the support member by the conditioning body by detecting a pressure within the sealed space.

171. The method of claim 170 wherein monitoring the conditioning body includes detecting a frictional force on the conditioning body in a plane generally parallel to a plane of the planarizing surface.

172. The method of claim 170 wherein the support member includes a generally upwardly extending portion coupled to the conditioning body and a generally laterally extending portion pivotably coupled to the upwardly extending portion, further wherein monitoring the conditioning body includes detecting a force between the upwardly extending portion and the laterally extending portion with a force sensor.

173. The method of claim 170 wherein the support member includes a piston slidably received in a cylinder and monitoring the conditioning body includes detecting a movement of one of the piston and the cylinder relative to the other of the piston and the cylinder.

174. The method of claim 170, further comprising biasing one of the piston and the cylinder toward or away from the other of the piston and the cylinder.

175. A method for monitoring conditioning of a planarizing medium used for planarizing a microelectronic substrate, the method comprising:

coupling a sensor to a conditioning body, wherein the conditioning body is coupled to a support member for supporting the conditioning body relative to the planarizing medium, and further wherein the support member includes a piston slidably and sealably received in a cylinder to form a sealed space between an end of the cylinder and an end of the piston;

engaging the conditioning body with the planarizing medium and moving at least one of the conditioning body and the planarizing medium relative to the other of the conditioning body and the planarizing medium while the conditioning body engages the planarizing medium; and monitoring the conditioning body to detect a frictional force between the conditioning body and the planarizing medium, wherein monitoring the conditioning body includes measuring a force transmitted to the support member by the conditioning body by detecting a pressure within the sealed space.

176. The method of claim 175 wherein monitoring the conditioning body further includes detecting a movement of one of the piston and the cylinder relative to the other of the piston and the cylinder.

177. A method for conditioning a planarizing medium used for planarizing a semiconductor substrate, the method comprising:

engaging a conditioning body with the planarizing medium, wherein the conditioning body is coupled to a support member for supporting the conditioning body relative to the planarizing medium, the support member including a piston slidably received in a cylinder;

moving at least one of the conditioning body and the planarizing medium relative to the other of the conditioning body and the planarizing medium to remove material from the planarizing medium; and maintaining an approximately constant frictional force between the conditioning body and the planarizing medium by adjusting a relative velocity between the conditioning body and the planarizing medium, wherein maintaining an approximately constant frictional force includes selecting a target frictional force, detecting a force between the conditioning body and the planarizing medium and adjusting the relative velocity until the force is approximately equal to the target frictional force, wherein detecting the force includes measuring a force transmitted to the support member by the conditioning body by detecting a movement of one of the piston and the cylinder relative to the other of the piston and the cylinder.

178. The method of claim 177 wherein the support member includes a generally upwardly extending portion coupled to the conditioning body and a generally laterally extending portion pivotally coupled to the upwardly extending portion, further wherein detecting the force includes detecting a force between the upwardly extending portion and the laterally extending portion with a force sensor.

179. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a first support member having first and second ends and being rotatably coupled toward the first end to the conditioning body, the second end of the first support member extending away from the conditioning body;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a second support member coupled at a pivotable coupling to the first support member toward the second end of the first support member, the sensor being positioned between the first and second support members, the first support member being pivotable relative to the second support member to transmit a force to the sensor corresponding to the frictional force;

a piston; and a cylinder having an open end and a closed end, the cylinder slidably and sealably engaging the piston, at least one of the piston and the cylinder being coupled to the conditioning body to slide relative to the other of the piston and the cylinder under the influence of the frictional force on the conditioning body, the piston and the cylinder defining a gap between an end of the piston and the closed end of the cylinder, the sensor including a gauge positioned to measure movement of the one of the piston and the cylinder relative to the other of the piston and the cylinder.

180. The apparatus of claim 179 wherein the planarizing medium includes a polishing pad.

181. The apparatus of claim 179 wherein the conditioning body has a conditioning surface generally parallel to the planarizing surface.

182. The apparatus of claim 179 wherein the conditioning body includes abrasive elements for abrading the planarizing surface of the planarizing medium.

183. The apparatus of claim 179 wherein the sensor includes a force sensor.

184. The apparatus of claim 179, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

185. The apparatus of claim 179, further comprising a biasing member coupled to the cylinder and the piston to bias the piston toward or away from the cylinder.

186. The apparatus of claim 179 wherein the gauge includes a pointer on one of the piston and the cylinder and a scale on the other of the piston and the cylinder, the pointer being aligned with the scale and movable relative to the scale to indicate relative movement between the piston and the cylinder.

187. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a first support member having first and second ends and being rotatably coupled toward the first end to the conditioning body, the second end of the first support member extending away from the conditioning body;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a second support member coupled at a pivotable coupling to the first support member toward the second end of the first support member, the sensor being positioned between the first and second support members, the first support member being pivotable relative to the second support member to transmit a force to the sensor corresponding to the frictional force;

a piston;

a cylinder having an open end and a closed end, the cylinder slidably receiving the piston, at least one of the piston and the cylinder being coupled to the conditioning body to slide relative to the other of the piston and the cylinder under the influence of the frictional force on the conditioning body, the piston and the cylinder defining a gap between an end of the piston and the closed end of the cylinder, the sensor including a gauge positioned to measure movement of the one of the piston and the cylinder relative to the other of the piston and the cylinder; and a biasing member coupled to the cylinder and the piston to bias the piston toward or away from the cylinder.

188. The apparatus of claim 187 wherein the planarizing medium includes a polishing pad.

189. The apparatus of claim 187 wherein the conditioning body has a conditioning surface generally parallel to the planarizing surface.

190. The apparatus of claim 187 wherein the conditioning body includes abrasive elements for abrading the planarizing surface of the planarizing medium.

191. The apparatus of claim 187 wherein the sensor includes a force sensor.

192. The apparatus of claim 187, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

193. The apparatus of claim 187 wherein the piston is sealably engaged with the cylinder.

194. The apparatus of claim 187 wherein the gauge includes a pointer on one of the piston and the cylinder and a scale on the other of the piston and the cylinder, the pointer being aligned with the scale and movable relative to the scale to indicate relative movement between the piston and the cylinder.

195. An apparatus for monitoring conditioning of a planarizing medium used for planarizing a microelectronic substrate, comprising:

a conditioning body having a conditioning surface configured to engage a planarizing surface of the planarizing medium, at least one of the conditioning body and the planarizing medium being movable relative to the other of the conditioning body and the planarizing medium to condition the planarizing surface;

a first support member having first and second ends and being rotatably coupled toward the first end to the conditioning body, the second end of the first support member extending away from the conditioning body;

a sensor coupled to the conditioning body to detect a frictional force in a plane of the planarizing surface, the frictional force being imparted to the conditioning body by the planarizing medium when the one of the conditioning body and the planarizing medium is moved relative to the other of the conditioning body and the planarizing medium;

a second support member coupled at a pivotable coupling to the first support member toward the second end of the first support member, the sensor being positioned between the first and second support members, the first support member being pivotable relative to the second support member to transmit a force to the sensor corresponding to the frictional force;

a piston; and a cylinder having an open end and a closed end, the cylinder slidably receiving the piston, at least one of the piston and the cylinder being coupled to the conditioning body to slide relative to the other of the piston and the cylinder under the influence of the frictional force on the conditioning body, the piston and the cylinder defining a gap between an end of the piston and the closed end of the cylinder, the sensor including a gauge positioned to measure movement of the one of the piston and the cylinder relative to the other of the piston and the cylinder, wherein the gauge includes a pointer on one of the piston and the cylinder and a scale on the other of the piston and the cylinder, the pointer being aligned with the scale and movable relative to the scale to indicate relative movement between the piston and the cylinder.

196. The apparatus of claim 195 wherein the planarizing medium includes a polishing pad.

197. The apparatus of claim 195 wherein the conditioning body has a conditioning surface generally parallel to the planarizing surface.

198. The apparatus of claim 195 wherein the conditioning body includes abrasive elements for abrading the planarizing surface of the planarizing medium.

199. The apparatus of claim 195 wherein the sensor includes a force sensor.

200. The apparatus of claim 195, further comprising an actuator coupled to the conditioning body for controlling at least one of a position of the conditioning body and an approximately normal force between the conditioning body and the planarizing medium, the actuator being coupled to the sensor to receive signals from the sensor and adjust the one of the position and the approximately normal force in response to the signal.

201. The apparatus of claim 195 wherein the piston is sealably engaged with the cylinder.

202. An apparatus for measuring forces during conditioning of a chemical-mechanical planarizing surface, comprising:

a planarizing medium having a planarizing surface for removing material from a microelectronic substrate, the planarizing surface defining a planarizing surface plane;

a conditioning body adjacent to the planarizing medium, at least one of the conditioning body and the planarizing medium being movable relative to the other of the conditioning body and the planarizing medium for conditioning the planarizing surface, the conditioning body and the planarizing medium generating a force in the planarizing surface plane when the one of the conditioning body and the planarizing medium moves relative to the other of the conditioning body and the planarizing medium;

a first support member having first and second ends and being rotatably coupled toward the first end to the conditioning body, the second end of the first support member extending away from the conditioning body;

a second support member coupled at a pivotable coupling to the first support member toward the second end of the first support member, the sensor being positioned between the first and second support members, the first support member being pivotable relative to the second support member to transmit a force to the sensor corresponding to the drag force;

a sensor operatively coupled to the conditioning body to detect the force;

a piston; and a cylinder having an open end and a closed end, the cylinder slidably and sealably engaging the piston, at least one of the piston and the cylinder being coupled to the conditioning body to slide relative to the other of the piston and the cylinder under the influence of the force on the conditioning body, the piston and the cylinder defining a gap between an end of the piston and the closed end of the cylinder, the force sensor including a gauge positioned to measure movement of the piston relative to the cylinder.

203. The apparatus of claim 202 wherein the planarizing medium includes a polishing pad.

204. The apparatus of claim 202 wherein the conditioning body has a conditioning surface generally parallel to the planarizing surface.

205. The apparatus of claim 202 wherein the conditioning body is rotatable relative to the planarizing medium.

206. The apparatus of claim 202 wherein the conditioning body is translatable relative to the planarizing medium.

207. The apparatus of claim 202 wherein the planarizing medium is rotatable relative to the conditioning body.

208. The apparatus of claim 202 wherein the sensor includes a force sensor.

209. The apparatus of claim 202, further comprising a biasing member coupled to the cylinder and the piston to bias the piston toward or away from the cylinder.

210. The apparatus of claim 202, further comprising a feedback device coupled to the sensor and the conditioning body for changing at least one of the force between the conditioning body and the polishing pad and a position of the conditioning body relative to the polishing pad in response to a signal from the sensor.

211. An apparatus for measuring forces during conditioning of a chemical-mechanical planarizing surface, comprising:

a planarizing medium having a planarizing surface for removing material from a microelectronic substrate, the planarizing surface defining a planarizing surface plane;

a conditioning body adjacent to the planarizing medium, at least one of the conditioning body and the planarizing medium being movable relative to the other of the conditioning body and the planarizing medium for conditioning the planarizing surface, the conditioning body and the planarizing medium generating a force in the planarizing surface plane when the one of the conditioning body and the planarizing medium moves relative to the other of the conditioning body and the planarizing medium;

a first support member having first and second ends and being rotatably coupled toward the first end to the conditioning body, the second end of the first support member extending away from the conditioning body;

a second support member coupled at a pivotable coupling to the first support member toward the second end of the first support member, the sensor being positioned between the first and second support members, the first support member being pivotable relative to the second support member to transmit a force to the sensor corresponding to the drag force;

a sensor operatively coupled to the conditioning body to detect the force;

a piston;

a cylinder having an open end and a closed end, the cylinder slidably receiving the piston, at least one of the piston and the cylinder being coupled to the conditioning body to slide relative to the other of the piston and the cylinder under the influence of the force on the conditioning body, the piston and the cylinder defining a gap between an end of the piston and the closed end of the cylinder, the force sensor including a gauge positioned to measure movement of the piston relative to the cylinder; and a biasing member coupled to the cylinder and the piston to bias the piston toward or away from the cylinder.

212. The apparatus of claim 211 wherein the planarizing medium includes a polishing pad.

213. The apparatus of claim 211 wherein the conditioning body has a conditioning surface generally parallel to the planarizing surface.

214. The apparatus of claim 211 wherein the conditioning body is rotatable relative to the planarizing medium.

215. The apparatus of claim 211 wherein the conditioning body is translatable relative to the planarizing medium.

216. The apparatus of claim 211 wherein the planarizing medium is rotatable relative to the conditioning body.

217. The apparatus of claim 211 wherein the sensor includes a force sensor.

218. The apparatus of claim 211 wherein the piston is sealably engaged with the cylinder.

219. The apparatus of claim 211, further comprising a feedback device coupled to the sensor and the conditioning body for changing at least one of the force between the conditioning body and the polishing pad and a position of the conditioning body relative to the polishing pad in response to a signal from the sensor.

220. A method for monitoring conditioning of a planarizing medium used for planarizing a microelectronic substrate, comprising:

moving at least one of the planarizing medium and a conditioning body relative to the other of the planarizing medium and the conditioning body while the conditioning body is engaged with a planarizing surface of the planarizing medium, wherein the conditioning body is coupled to a support member for supporting the conditioning body relative to the planarizing medium, the support member including a generally upwardly extending portion coupled to the conditioning body and a generally laterally extending portion pivotably coupled to the upwardly extending portion, further wherein the support member includes a piston slidably received in a cylinder;

monitoring the conditioning body to detect a force of the planarizing medium on the conditioning body, wherein monitoring the conditioning body includes measuring a force transmitted to the support member by the conditioning body by detecting a movement of one of the piston and the cylinder relative to the other of the piston and the cylinder; and biasing one of the piston and the cylinder toward or away from the other of the piston and the cylinder.

221. The method of claim 220 wherein monitoring the conditioning body includes detecting a frictional force on the conditioning body in a plane generally parallel to a plane of the planarizing surface.

222. The method of claim 220 wherein the support member includes a piston slidably and sealably received in a cylinder to form a sealed space between an end of the cylinder and an end of the piston, further wherein monitoring the conditioning body includes detecting a pressure within the sealed space.

223. The method of claim 220, further comprising removing material from the planarizing medium while at least one of the conditioning body and the planarizing medium moves relative to the other of the conditioning body and the planarizing medium.

224. The method of claim 220, further comprising adjusting a force applied to the conditioning body approximately normal to the planarizing surface in response to detecting a force of the planarizing medium on the conditioning body.

225. The method of claim 220 wherein moving at least one of the planarizing medium and the conditioning body includes rotating the planarizing medium at a variable rate as the conditioning body moves across the planarizing medium to maintain a relative velocity between the planarizing medium and the conditioning body at an approximately constant value.

226. A method for monitoring conditioning of a planarizing medium used for planarizing a microelectronic substrate, comprising:

moving at least one of the planarizing medium and a conditioning body relative to the other of the planarizing medium and the conditioning body while the conditioning body is engaged with a planarizing surface of the planarizing medium, wherein the conditioning body is coupled to a support member for supporting the conditioning body relative to the planarizing medium, the support member including a generally upwardly extending portion coupled to the conditioning body and a generally laterally extending portion pivotably coupled to the upwardly extending portion, wherein the support member includes a piston slidably and sealably received in a cylinder to form a sealed space between an end of the cylinder and an end of the piston; and monitoring the conditioning body to detect a force of the planarizing medium on the conditioning body, wherein monitoring the conditioning body includes measuring a force transmitted to the support member by the conditioning body by detecting a pressure within the sealed space.

227. The method of claim 226 wherein monitoring the conditioning body includes detecting a frictional force on the conditioning body in a plane generally parallel to a plane of the planarizing surface.

228. The method of claim 226 wherein the support member includes a piston slidably received in a cylinder and monitoring the conditioning body includes detecting a movement of one of the piston and the cylinder relative to the other of the piston and the cylinder.

229. The method of claim 228, further comprising biasing one of the piston and the cylinder toward or away from the other of the piston and the cylinder.

230. The method of claim 226, further comprising removing material from the planarizing medium while at least one of the conditioning body and the planarizing medium moves relative to the other of the conditioning body and the planarizing medium.

231. The method of claim 226, further comprising adjusting a force applied to the conditioning body approximately normal to the planarizing surface in response to detecting a force of the planarizing medium on the conditioning body.

232. The method of claim 226 wherein moving at least one of the planarizing medium and the conditioning body includes rotating the planarizing medium at a variable rate as the conditioning body moves across the planarizing medium to maintain a relative velocity between the planarizing medium and the conditioning body at an approximately constant value.

* * * * *

UNITED STATES PATENT AND TRADEMARK OFFICE

CERTIFICATE OF CORRECTION

PATENT NO. : 6,969,297 B2
APPLICATION NO. : 09/782892
DATED : November 29, 2005
INVENTOR(S) : Scott E. Moore It is certified that error appears in the above-identified patent and that said Letters Patent is hereby corrected as shown below:

| Column, Line | Reads | Should Read |
|---|---|---|
| Column 3, Line 5 | "Alternatively, (for example," | --Alternatively (for example,-- |
| Column 3, Line 29 | "signal received form" | --signal received from-- |
| Column 5, Line 27 | "material removed form" | --material removed from-- |
| Column 6, Line 46 | "the two surface." | --the two surfaces.-- |
| Column 6, Lines 47-50 | "The relative velocity between the two surfaces can in turn be a function of the rotational and/or translational speed of the polishing pad **127**, the position of the conditioning body **150** relative to the polishing pad **127**." | --The relative velocity between the two surfaces can in turn be a function of the rotational and/or translational speed of the the polishing pad **127**, the rotational and/or translational speed of the conditioning body **150**, and the position of the conditioning body **150** relative to the polishing pad **127**.-- |
| Column 7, Line 35 | "force sensor **180** can be" | --force sensor **180**, can be-- |
| Column 8, Line 8 | "then toward" | --than toward-- |

UNITED STATES PATENT AND TRADEMARK OFFICE

CERTIFICATE OF CORRECTION

PATENT NO. : 6,969,297 B2
APPLICATION NO. : 09/782892
DATED : November 29, 2005
INVENTOR(S) : Scott E. Moore It is certified that error appears in the above-identified patent and that said Letters Patent is hereby corrected as shown below:

| Column, Line | Reads | Should Read |
|---|---|---|
| Column 24, Lines 33-40 | "a conditioning body adjacent to the planarizing medium, at least one of the conditioning body and the planarizing medium being movable relative to the other of the conditioning body and the planarizing medium for conditioning the planarizing surface, the conditioning body and the planarizing medium generating a force in the planarizing medium moves relative to the other of the conditioning body and the planarizing medium;" | --a conditioning body adjacent to the planarizing medium, at least one of the conditioning body and the planarizing medium being movable relative to the other of the conditioning body and the planarizing medium for conditioning the planarizing surface, the conditioning body and the planarizing medium generating a force in the planarizing surface plane when the one of the conditioning body and the planarizing medium moves relative to the other of the conditioning body and the planarizing medium;-- |

UNITED STATES PATENT AND TRADEMARK OFFICE

CERTIFICATE OF CORRECTION

PATENT NO. : 6,969,297 B2
APPLICATION NO. : 09/782892
DATED : November 29, 2005
INVENTOR(S) : Scott E. Moore It is certified that error appears in the above-identified patent and that said Letters Patent is hereby corrected as shown below:

| Column, Line | Reads | Should Read |
|---|---|---|
| Column 24, Line 52 | "detect the force; the sensor" | --detect the force, the sensor-- |
| Column 27, Line 57 | "the sensor is positioned" | --the sensor positioned-- |

Signed and Sealed this

Sixth Day of November, 2007

JON W. DUDAS
*Director of the United States Patent and Trademark Office*